US009357279B2

(12) United States Patent
Lucas et al.

(10) Patent No.: US 9,357,279 B2
(45) Date of Patent: May 31, 2016

(54) ELASTOMERIC TORSION BUSHINGS FOR LEVERED LOUDSPEAKERS

(71) Applicant: Bose Corporation, Framingham, MA (US)

(72) Inventors: Brian M. Lucas, Marblehead, MA (US); Geoffrey C. Chick, Norfolk, MA (US); Johan H. Isaksson, Malmo (SE)

(73) Assignee: Bose Corporation, Framingham, MA (US)

( * ) Notice: Subject to any disclaimer, the term of this patent is extended or adjusted under 35 U.S.C. 154(b) by 91 days.

(21) Appl. No.: 14/200,614

(22) Filed: Mar. 7, 2014

(65) Prior Publication Data

US 2015/0256911 A1 Sep. 10, 2015

(51) Int. Cl.

| | |
|---|---|
| ***H04R 1/00*** | (2006.01) |
| ***H04R 1/02*** | (2006.01) |
| ***H04R 7/16*** | (2006.01) |
| ***H04R 11/02*** | (2006.01) |

(52) U.S. Cl.
CPC .. *H04R 1/02* (2013.01); *H04R 7/16* (2013.01); *H04R 11/02* (2013.01)

(58) Field of Classification Search
CPC ..... H04R 11/02; H04R 9/06
USPC ..... 381/390, 398
See application file for complete search history.

(56) References Cited

U.S. PATENT DOCUMENTS

| | | | |
|---|---|---|---|
| 1,718,357 | A | 6/1929 | Miller |
| 1,756,201 | A | 4/1930 | Kiernan |
| 1,823,512 | A | 9/1931 | Ringel |
| 1,973,277 | A | 9/1934 | Barfield |
| 2,035,104 | A | 3/1936 | Thomas |
| 2,078,469 | A | 4/1937 | Thomas |
| 2,245,511 | A | 6/1941 | Turnbull |
| 3,777,078 | A | 12/1973 | Boutros-Attia et al. |
| 3,836,733 | A | 9/1974 | Cragg |
| 3,937,904 | A | 2/1976 | Parker |
| 4,626,717 | A | 12/1986 | Hensing et al. |
| 5,216,723 | A | 6/1993 | Froeschle et al. |
| 5,802,189 | A | 9/1998 | Blodget |
| 6,405,599 | B1 | 6/2002 | Patt |
| 6,415,037 | B1 | 7/2002 | Wang |

(Continued)

FOREIGN PATENT DOCUMENTS

| | | |
|---|---|---|
| CN | 203015064 U | 6/2013 |
| CN | 203193871 U | 9/2013 |

(Continued)

OTHER PUBLICATIONS http://bushingsinc.com/index.php/bushings-inc-products-lines/rubber-flex-bushings; retrieved 2007.*

(Continued)

*Primary Examiner* — Sunita Joshi

(57) ABSTRACT

A loudspeaker includes an acoustic diaphragm, an oscillatory force source, a lever coupling the oscillatory force source to the acoustic diaphragm, and a pivot coupled to the lever such that the lever moves in an arcuate path about the pivot when the oscillatory force source applies a force to the lever. The pivot includes at least one torsion bushing. The at least one torsion bushing includes a first member, a second member coupled to the lever and movable relative to the first member, and an elastomeric member coupling the first member to the second member.

19 Claims, 22 Drawing Sheets

(56) References Cited

U.S. PATENT DOCUMENTS

| | | | | |
|---|---|---|---|---|
| 7,247,957 | B2 | 7/2007 | Dadd | |
| 8,139,813 | B2 | 3/2012 | Kobayashi et al. | |
| 2008/0247595 | A1 | 10/2008 | Henry | |
| 2011/0243365 | A1 | 10/2011 | Carlmark et al. | |
| 2011/0243366 | A1* | 10/2011 | Carlmark ..... | H04R 11/02 381/398 |
| 2012/0106772 | A1 | 5/2012 | Horigome et al. | |
| 2012/0248899 | A1 | 10/2012 | Oommen et al. | |
| 2014/0064539 | A1 | 3/2014 | Link et al. | |
| 2014/0270328 | A1 | 9/2014 | Lucas et al. | |
| 2014/0334662 | A1 | 11/2014 | Lin | |

FOREIGN PATENT DOCUMENTS

| | | | |
|---|---|---|---|
| GB | 212648 | A | 3/1924 |
| GB | 1124830 | A | 8/1968 |
| JP | S6212300 | | 1/1987 |
| JP | 2009225091 | A | 10/2009 |

OTHER PUBLICATIONS

International Search Report and Written Opinion dated Jun. 2, 2015 for International application No. PCT/US2015/018279.

International Search Report and Written Opinion dated May 26, 2015 for International application No. PCT/US2015/018699.

International Search Report and Written Opinion dated May 20, 2015 for International application No. PCT/US2015/018702.

International Search Report and Written Opinion dated May 29, 2015 for International application No. PCT/US2015/018714.

International Search Report and Written Opinion dated Aug. 4, 2014 for International application No. PCT/US2014/021559.

International Search Report and Written Opinion dated Aug. 4, 2014 for International application No. PCT/US2014/021592.

* cited by examiner

ELASTOMERIC TORSION BUSHINGS FOR LEVERED LOUDSPEAKERS

BACKGROUND

This disclosure relates to elastomeric torsion bushings, and more particularly to elastomeric torsion bushings which provide pivots for lever arms used to drive motion of acoustic diaphragms in loudspeakers.

SUMMARY

This disclosure is based, in part, on the realization that elastomeric torsion bushings can be utilized to provide pivots for lever arms used to drive motion of acoustic diaphragms in loudspeakers. The use of such bushings in this manner can provide a low cost method for forming the pivot. Such bushings can also exhibit high radial and/or axial stiffness, which can be beneficial for resisting radial and/or axial crashing forces.

In one aspect, a loudspeaker includes an acoustic diaphragm, an oscillatory force source, a lever coupling the oscillatory force source to the acoustic diaphragm, and a pivot coupled to the lever such that the lever moves in an arcuate path about the pivot when the oscillatory force source applies a force to the lever. The pivot includes at least one torsion bushing. The at least one torsion bushing includes a first member, a second member coupled to the lever and movable relative to the first member, and an elastomeric member coupling the first member to the second member.

Implementations may include one of the following features, or any combination thereof.

In some implementations, the elastomeric member is formed of an elastomer such as silicone rubber or polyurethane.

In certain implementations, a first surface of the elastomeric member is bonded to the first member, and a second surface of the elastomeric member is bonded to the second member such that the second surface moves with the second member relative to the first surface.

In some implementations, the elastomeric member is formed between the first and second members in a mold-in-place process.

In certain implementations, the elastomeric member is bonded to the first member and the second member with an adhesive.

In some implementations, the elastomeric member is in the form of a frusto-cone having a hollow center region. The frusto-cone has an outer diameter that tapers at a first taper angle along the length of the frusto-cone and an inner diameter that tapers at a second taper angle along the length of the hollow center region. The second member includes a tapered recess within which the elastomer is disposed. The tapered recess tapers at the first taper angle, and the first member includes a tapered portion that tapers at the second taper angle.

In certain implementations, the second taper angle is smaller than the first taper angle such that the elastomeric member has a substantially constant thickness ratio (e.g., about 1.2 to about 3) along the length of the hollow center region, wherein the thickness ratio is the ratio of the outer diameter to the inner diameter.

In certain implementations, the elastomeric member is in the form of a hollow cylinder having a thickness ratio of about 1.2 to about 3, wherein the thickness ratio is the ratio of an outer diameter of the hollow cylinder to an inner diameter of the hollow cylinder.

In some implementations, the elastomeric member includes a plurality of elastomeric ribs each having a first end connected to the first member and a second end connected to the second member.

In certain implementations, the loudspeaker includes an enclosure, and a surround that connects the acoustic diaphragm to the enclosure. The first member can be fixed in position relative to the enclosure.

In some implementations, at least one end of the first member is secured to the enclosure.

In certain implementations, the surround is mounted to a frame and the frame is connected to the enclosure, and at least one end of the first member is secured to the enclosure via the frame.

In some implementations, the oscillatory force source includes a moving magnet motor. The moving magnet motor includes an armature that is coupled to the lever and includes a permanent magnet, and a stator for creating magnetic flux for the armature to interact with, thereby to drive motion of the acoustic diaphragm.

In certain implementations, the moving magnet motor is arranged such that magnetic crashing forces resulting from magnetic attraction between the stator and the one or more permanent magnets are substantially parallel to an axis of rotation of the lever.

In some implementations, the moving magnet motor is arranged such that magnetic crashing forces resulting from magnetic attraction between the stator and the one or more permanent magnets are substantially perpendicular to an axis of rotation of the lever.

In another aspect, a loudspeaker includes an acoustic diaphragm and a moving magnet motor. The moving magnet motor includes an armature comprising a permanent magnet, and a stator for creating magnetic flux for the armature to interact with, thereby to drive motion of the armature. The loudspeaker also includes a lever that couples the armature and the acoustic diaphragm to transmit motion of the armature to the acoustic diaphragm to cause the acoustic diaphragm to move, and a pivot that is coupled to lever so that motion of the armature causes the lever to move in an arcuate path about the pivot. The pivot includes a pair of elastomeric torsion bushings. Each of the elastomeric torsion bushings includes a first member, a second member that is coupled to the lever and is movable relative to the first member, and an elastomeric member that couples the first member to the second member.

Implementations may include one of the following features, or any combination thereof.

In some implementations, the elastomeric torsion bushings are spaced apart so as to allow the acoustic diaphragm to move therebetween.

Implementations can provide one or more of the following advantages.

In some implementations, the use of one or more elastomeric torsion bushings provide for a frictionless pivot for a lever arm used to drive motion of acoustic diaphragm.

In certain implementations, the use of one or more elastomeric torsion bushings provides for a pivot that has low torsional stiffness (e.g., 0.1-1 Nm/rad).

In some implementations, the use of one or more elastomeric torsion bushings provides for a pivot that has high radial stiffness (e.g., 200-2000 N/mm) and/or high axial stiffness (50-500 N/mm).

Other aspects, features, and advantages are in the description, drawings, and claims.

DETAILED DESCRIPTION

Figure 1A:
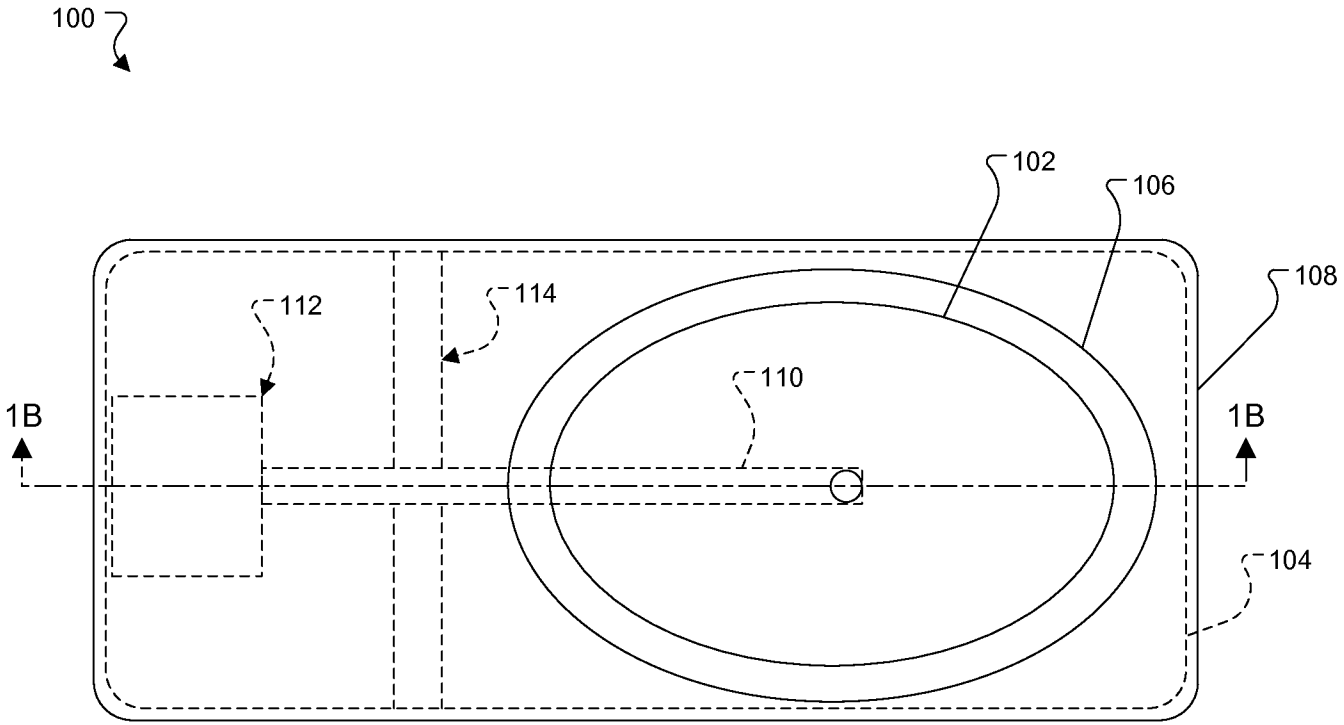
FIG. 1A is a top plan view of a loudspeaker that employs an elastomeric torsion bushing for providing a pivot for a lever that drives an acoustic diaphragm.
Figure 1B:
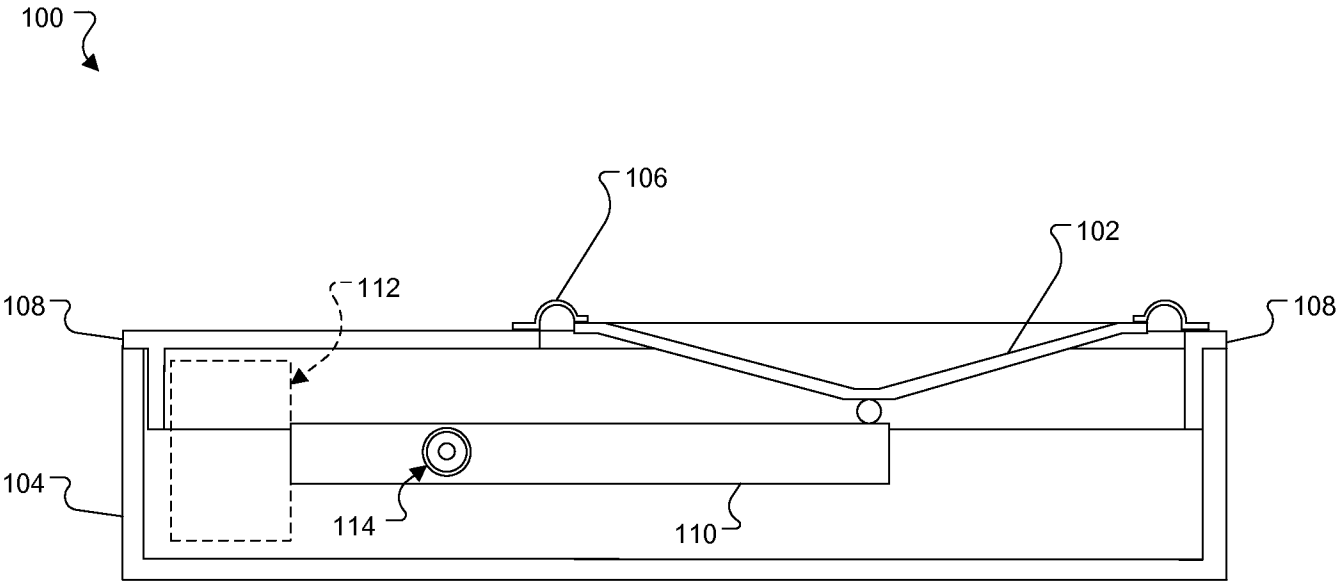
FIG. 1B is a cross-sectional side view of the loudspeaker of FIG. 1A, taken along line 1B-1B.

Referring to FIGS. 1A and 1B loudspeaker 100 includes an acoustic diaphragm 102 (e.g., a cone type speaker diaphragm, also known simply as a "cone") that is mounted to an enclosure 104, which may be metal, plastic, or other suitable material, by a surround 106, which functions as a pneumatic seal and as a suspension element. For example, in some instances the surround 106 is mounted to a frame 108 and the frame 108 is connected to the enclosure 104. The loudspeaker 100 includes a lever 110 that is mechanically connected at one point along the lever 110 to the acoustic diaphragm 102 and at another point along the lever 110 to an oscillatory force source 112.

Figure 2:
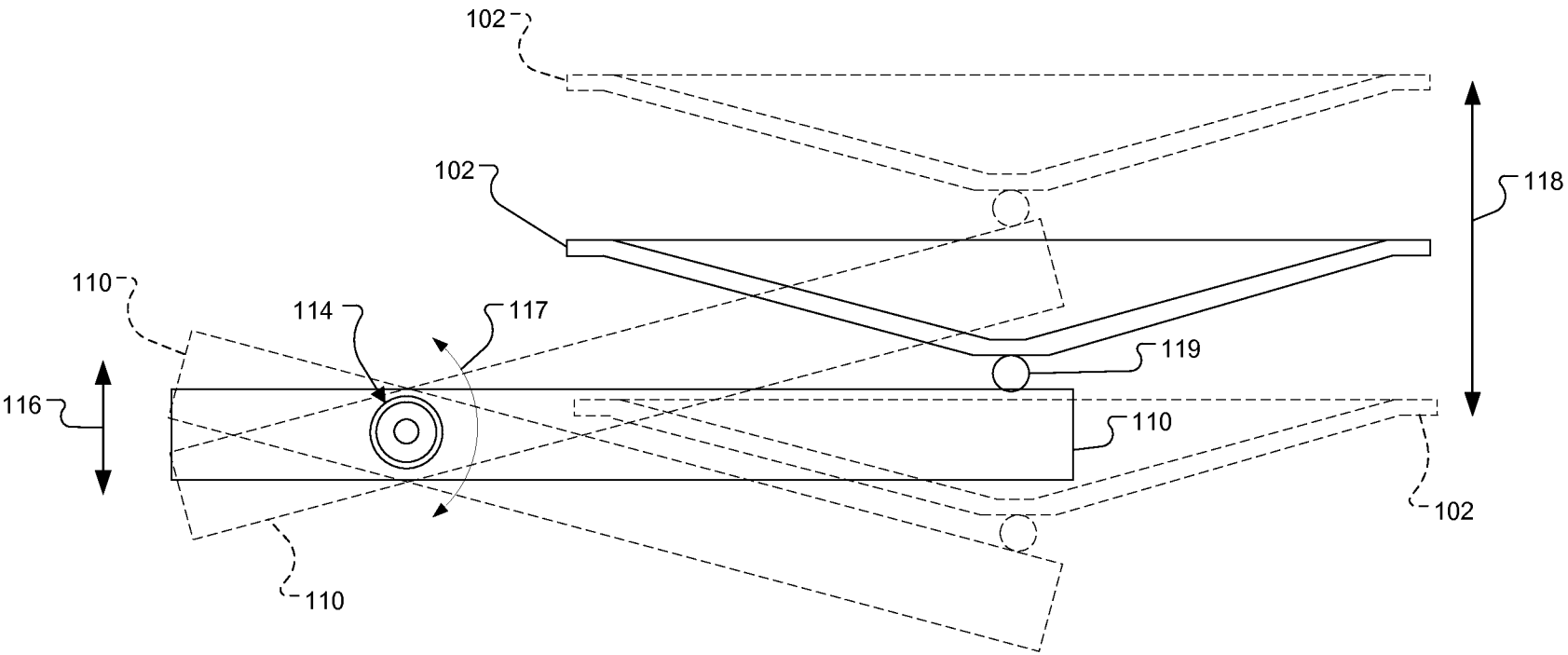
FIG. 2 illustrates oscillatory, arcuate movement of the lever and pistonic movement of an acoustic diaphragm of the loudspeaker of FIG. 1A.

The lever 110 is pivotally connected to a mechanical ground reference, such as the enclosure 104 or the frame 108, via a pivot 114. As illustrated in FIG. 2, when an oscillatory force (arrow 116) is applied to the lever 110 via the oscillatory force source 112 (FIG. 1A), the lever 110 is driven in an arcuate path (arrow 117) about the pivot 114. The motion of the lever 110 is transferred to the acoustic diaphragm 102 via the connection point, which causes the acoustic diaphragm 102 to move along a path (arrow 118) between a fully extended position and a fully retracted position. In some cases, the connection point may include a connector 119, such as a hinge or link, which allows the lever 110 to move relative to the acoustic diaphragm 102, thereby to allow the acoustic diaphragm 102 to move in a pistonic motion (arrow 118), rather than following the arcuate path of the lever 110.

Figure 3A:
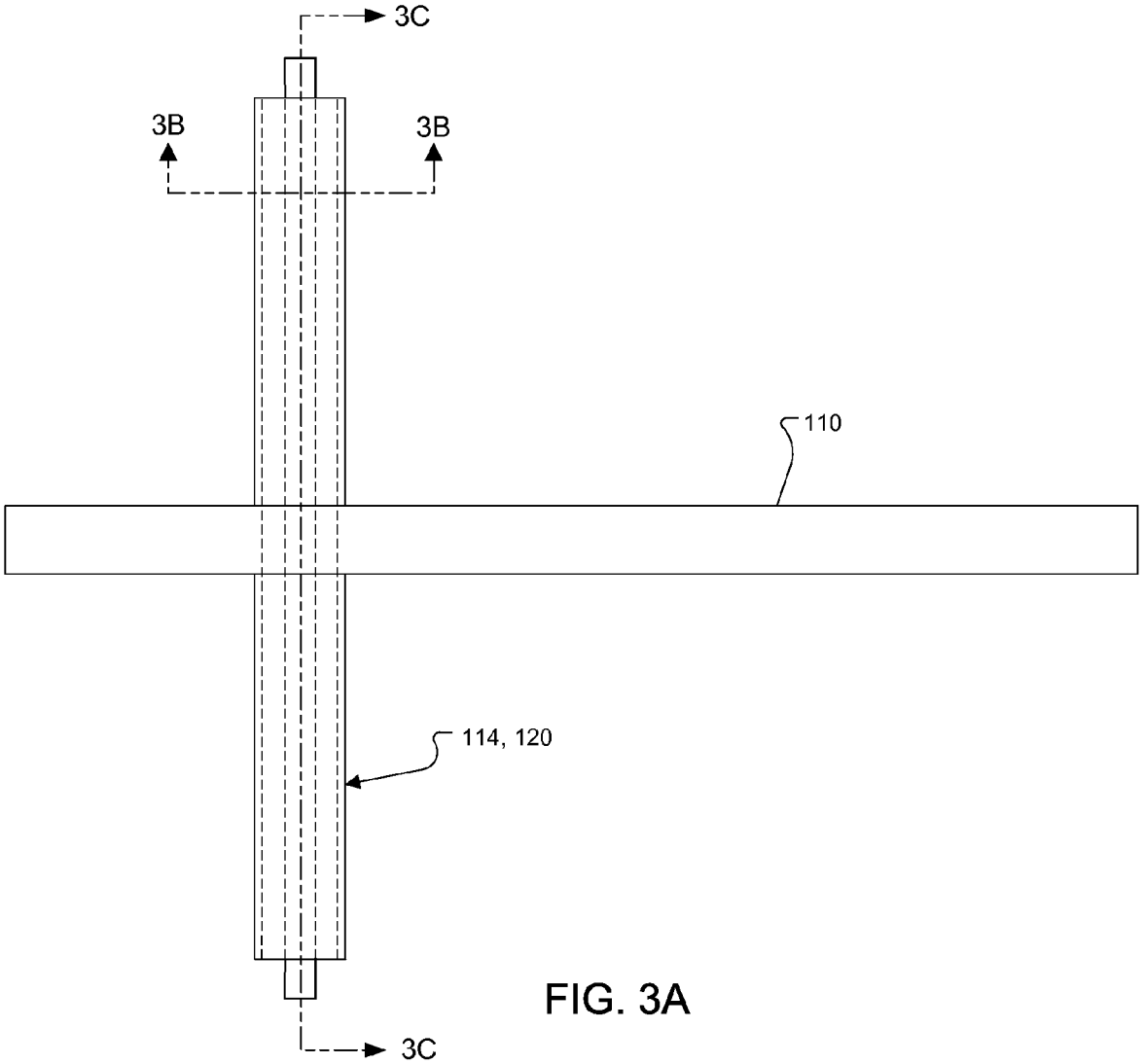
FIG. 3A is a top view of the pivot and lever of FIG. 1A.
Figure 3C:
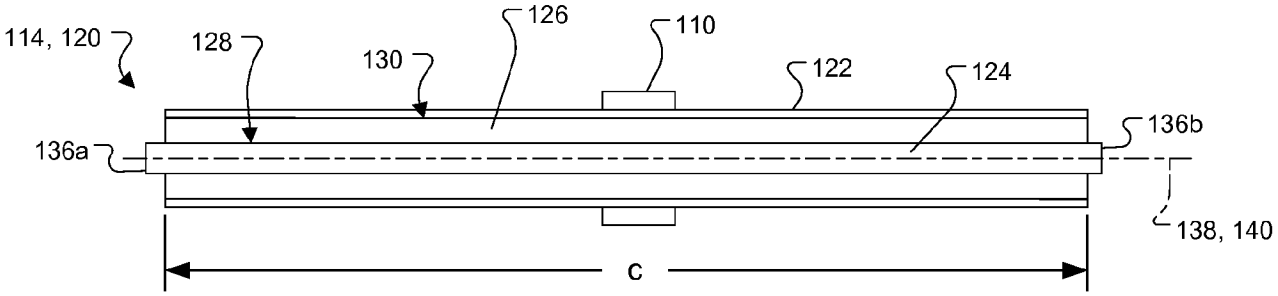
FIG. 3C is a cross-sectional view of the pivot and lever of FIG. 3A, taken along line 3C-3C.
Figure 3B:
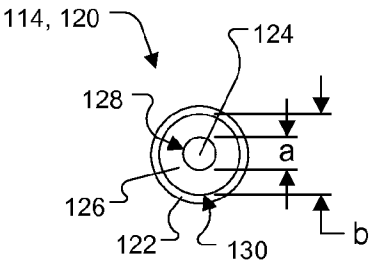
FIG. 3B is a cross-sectional view of the pivot of FIG. 3A, taken along line 3B-3B.

To facilitate the arcuate motion of the lever 110, the pivot 114 includes at least one elastomeric torsion bushing. FIGS. 3A, 3B, and 3C illustrate one implementation of the pivot 114 which includes such an elastomeric torsion bushing 120. The elastomeric torsion bushing 120 provides a low cost, frictionless hinge for the lever 110.

The bushing 120 includes a first, outer (housing) member 122; a second, inner (pin) member 124; and an elastomeric member 126 disposed therebetween. A first, inner surface 128 of the elastomeric member 126 is bonded to the inner member 124 and a second, outer surface 130 of the elastomeric member 126 is bonded to the outer member 122 such that the outer surface 130 of the elastomeric member 126 moves with the outer member 122, during rotation of the lever 110, relative to the inner surface 128. At least one of the opposing ends 136*a*, 136*b* of the inner member 124 is fixed to a mechanical ground reference, such as the enclosure 104 (FIG. 1A) or the frame 108 (FIG. 1A) and such that a longitudinal axis 138 of the inner member 124 is coincident with the axis of rotation 140 of the lever 110. The outer member 122 is coaxial with the inner member 124 and is secured to the lever 110 such that the outer member 122 rotates with the lever 110 relative to the inner member 124. In some cases, the lever 110 and the outer member 122 may both be part of one unitary structure.

The outer and inner members 122, 124 can be formed of a metal, such as steel, or other suitable high stiffness material (e.g., plastics). The elastomeric member 126 is formed of an elastomer, such as silicone rubber, polyurethane, etc. Silicone materials may be beneficial because they tend to exhibit very good properties of creep. Silicone rubber, for example, can offer several material property benefits, such as temperature stability; low modulus; low, moderate, or high dissipation factor (tan δ) is possible; good creep resistance; fast curing using catalysts and elevated temperatures; injection moldable; and can offer very high elongation (e.g., about 900%). The elastomeric member 126 can be formed between the outer and inner members 122, 124 using a mold-in-place process, which provides sufficiently high strength bonding between the elastomeric member 126 and the outer and inner members 122, 124 and which allows the parts to be of lower tolerance since the elastomeric member 126 forms to the shape of the space between the outer and inner members 122, 124. Alternatively, the parts could be formed (e.g., molded and/or machined) separately and then bonded together using an adhesive. Alternatively or additionally, the outer member 122, the inner member 124, and the elastomeric member 126 could be connected together using geometric locking.

It can be desirable to design the bushing 120 to have high axial and radial stiffness relative to rotational stiffness, while keeping strain from a given rotation below the fatigue limit of the elastomeric material. The following equations (1), (2) and (3) describe axial to rotational stiffness ratio, radial to rotational stiffness ratio and peak strain:

$$\frac{ka}{k\theta} = \frac{1}{2} \cdot \frac{1}{a^2} \cdot \frac{t^2 - 1}{t^2 \cdot \ln(t)} \quad (1)$$

$$\frac{kr}{k\theta} = \frac{1}{a^2} \cdot \frac{(t^4 - 1)}{[t^2 \cdot (\ln(t) + 1) + t^4 \cdot (\ln(t) - 1)]} \quad (2)$$

$$\varepsilon_p(\theta) = \frac{t^2}{(t^2 - 1)} \cdot \theta \quad (3)$$

where, t=thickness ratio of the elastomeric member; described by equation (4):

$$t = \frac{b}{a} \quad (4)$$

and, a=inner diameter of the elastomeric member, b=outer diameter of the elastomeric member, and θ=angle of rotation (in radians) of the outer surface of the elastomeric member relative to the inner surface of the elastomeric member.

It has been found that a thickness ratio "t" of about 1.2 to about 3 (e.g., 2) generally provides a bushing with sufficiently low peak torsional strain (e.g., less than 20%) and torsional stiffness (e.g., 0.1-1 Nm/rad), and sufficiently high axial stiffness (e.g., 50-500 N/mm) and radial stiffness (e.g., 200-2000 N/mm).

Equations (1) and (2) also show that the stiffness ratios improve when the inner diameter "a" of the elastomeric member 126 is minimized. However, it is worth noting that there are limits to how small "a" can be made. Those limits include: stiffness of the inner member 124, and shear forces between the elastomeric member 126 and the inner member 124. As the inner diameter "a" is reduced the shearing load resulting from the rotation of the outer member 122 relative to the inner member 124 acts on a diminishing surface area. The inner diameter "a" needs to be large enough to provide sufficient surface area so that the shearing load does not exceed the strength of the bond between the elastomeric member 126 and the inner member 124.

Figure 4:
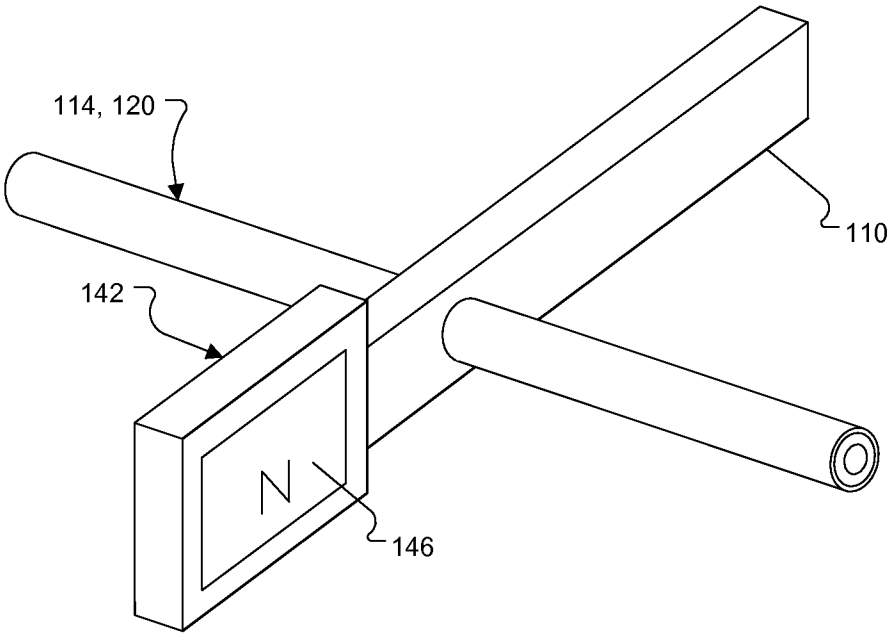
FIG. 4 is a perspective view of the pivot and lever of FIG. 1A including an armature for a moving magnet motor.
Figure 5:
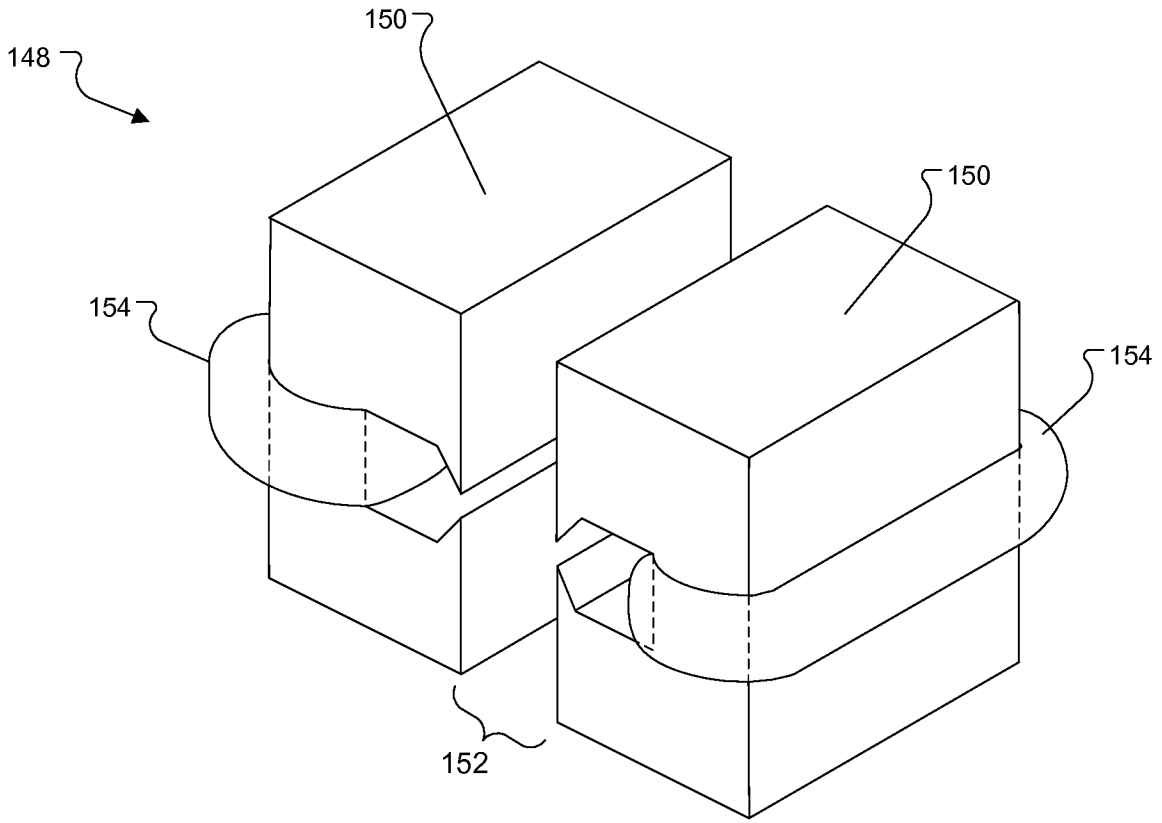
FIG. 5 is a perspective view of a stator for a moving magnet motor.
Figure 6A:
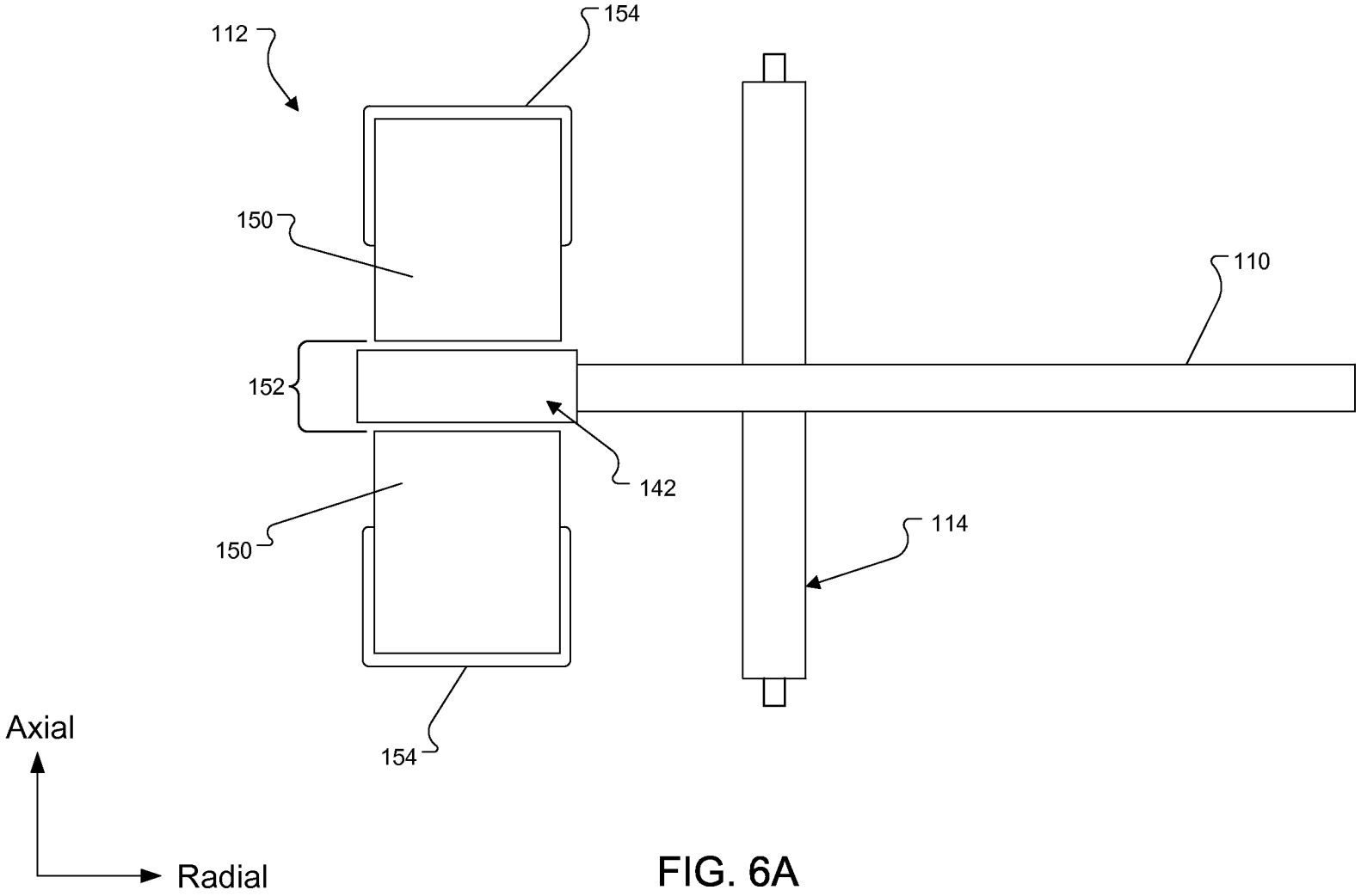
FIGS. 6A, 6B, and 6C are top, end, and side views, respectively, of the pivot and lever of FIG. 1A together with a moving magnet motor.
Figure 6B:
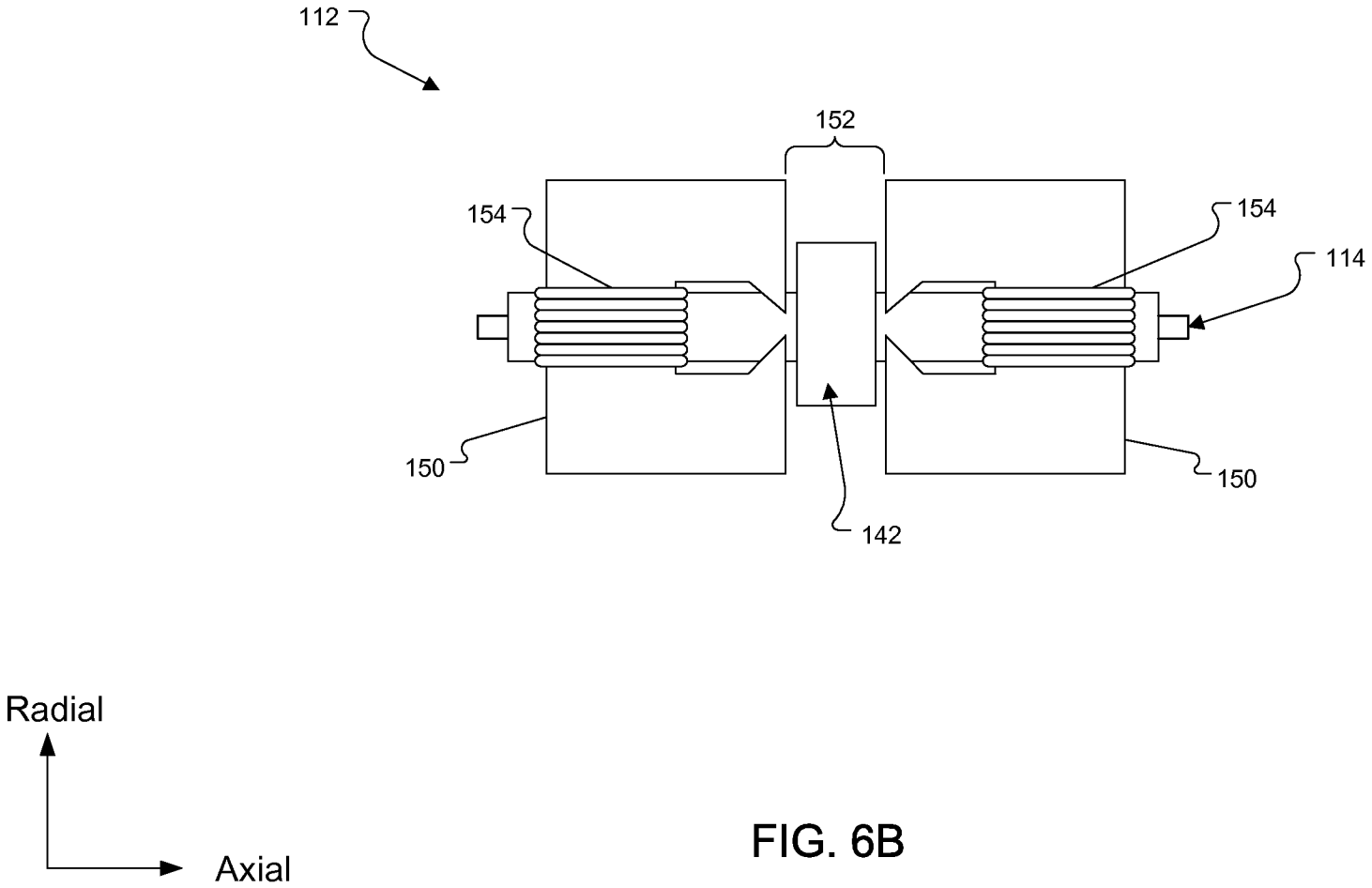
Figure 6C:
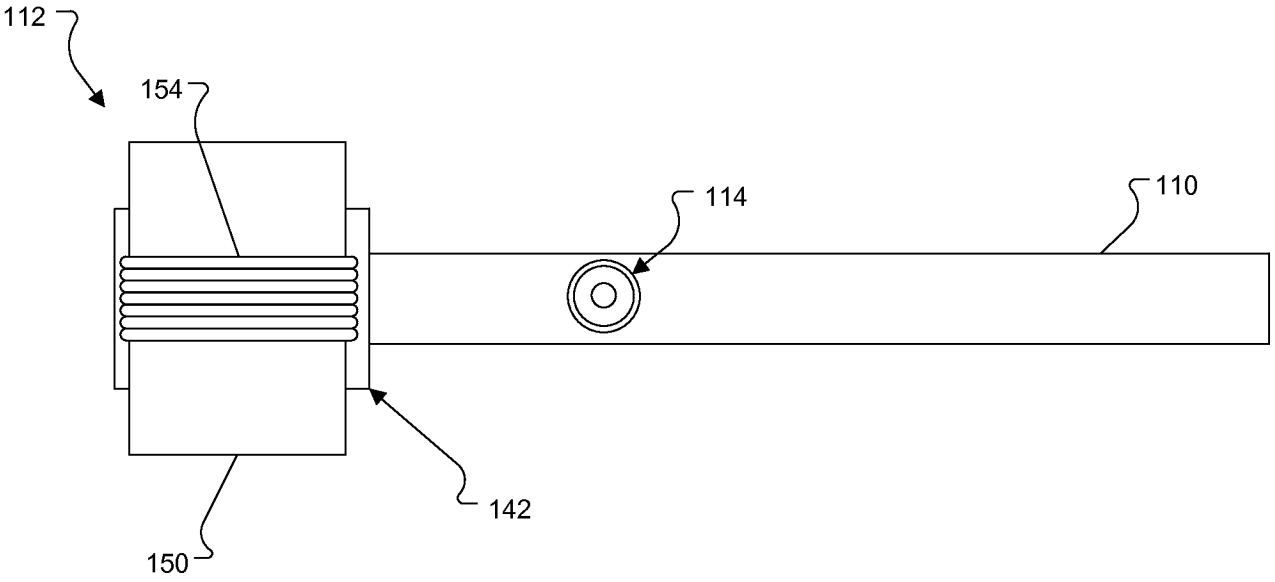

FIGS. 4, 5, 6A, 6B and 6C illustrate one implementation of the oscillatory force source 112 (FIG. 6A) for applying force to the lever 110. With reference to FIG. 4, in the illustrated implementation, the oscillatory force source 112 includes a substantially planar armature 142 that is attached to the lever 110. The armature 142 includes one or more permanent magnets 146 (one shown). The armature 142 and the lever 110 may be part of one unitary structure. Referring to FIG. 5, the oscillatory force source 112 also includes a stator 148 that includes one or more cores 150 (two shown) which define an air gap 152. The cores 150 are formed of high magnetic permeability material around which coils 154 are wound. As shown in FIGS. 6A and 6B, the lever 110 is positioned such that the armature 142 is in the air gap 152 and electrical current is passed through the coils so that that the combination of the armature 142, the cores 150, and the coils 154 form a moving magnet motor. In this arrangement, the force results from the interaction of the magnetic field in the gap due to the current flowing in the coils 154 and the magnetic field of the permanent magnet 146, so the force is applied to the lever 110 in a non-contact manner.

Moving magnet motors can be subject to a magnetic crashing force which results from magnetic attraction between the stator 148 and armature 142. In the illustrated example, the crashing force is substantially in the axial direction, and varies as a function of the distance between the armature 142 and the cores 150; the closer the permanent magnet 146 is to the cores 150, the stronger the magnetic crashing force. It may be convenient to think of the structure as requiring a crashing stiffness that inhibits the armature 142 from crashing into the cores 150. Here, since the magnetic crashing force is in the axial direction, the high axial stiffness of the elastomeric torsion bushing 120 can be beneficial to ensure that there is little relative motion between the armature 142 and the cores 150 in the axial direction (as shown in FIGS. 6A and 6B).

Figure 7A:
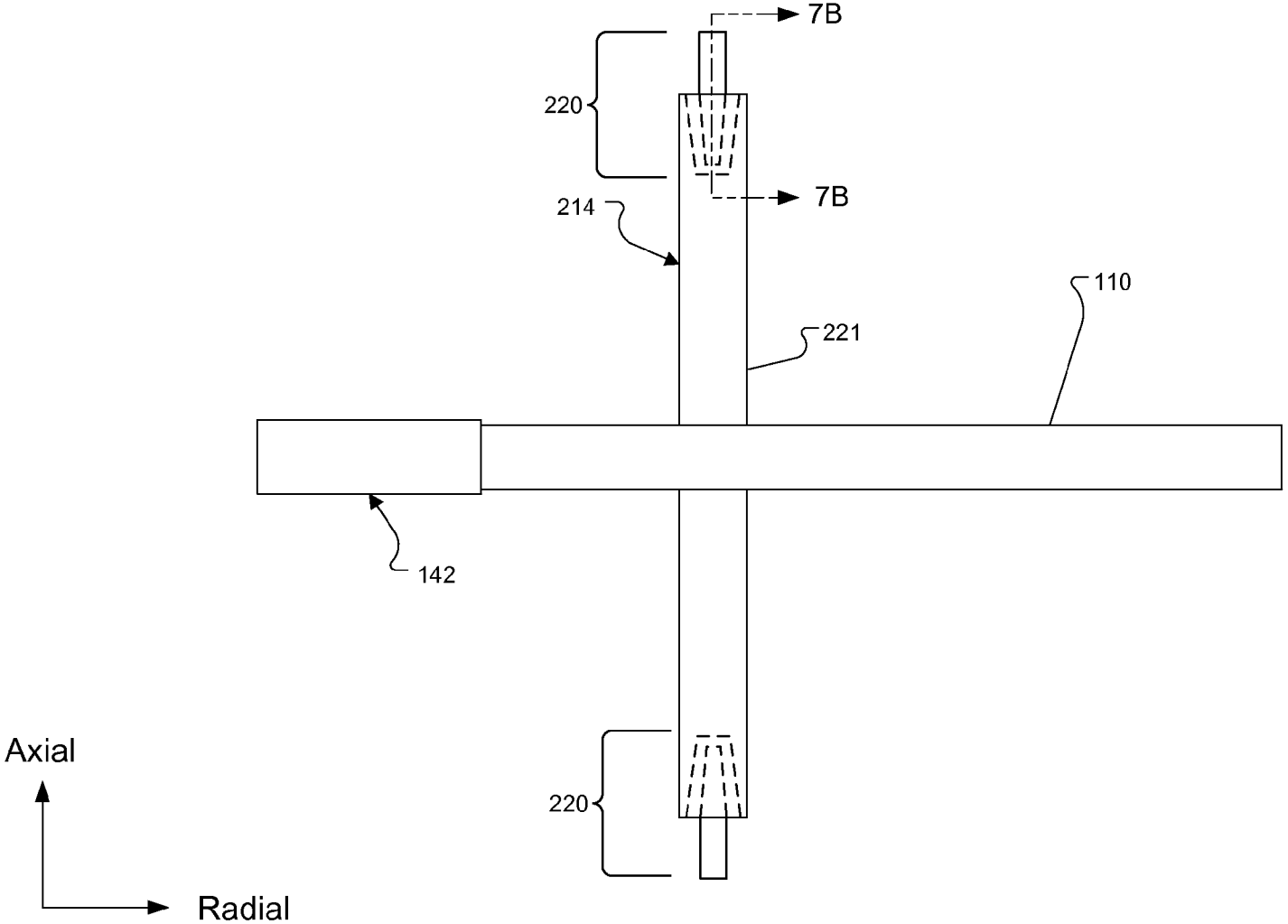
FIG. 7A is a top view of the lever of FIG. 1A with an alternative pivot arrangement.
Figure 7B:
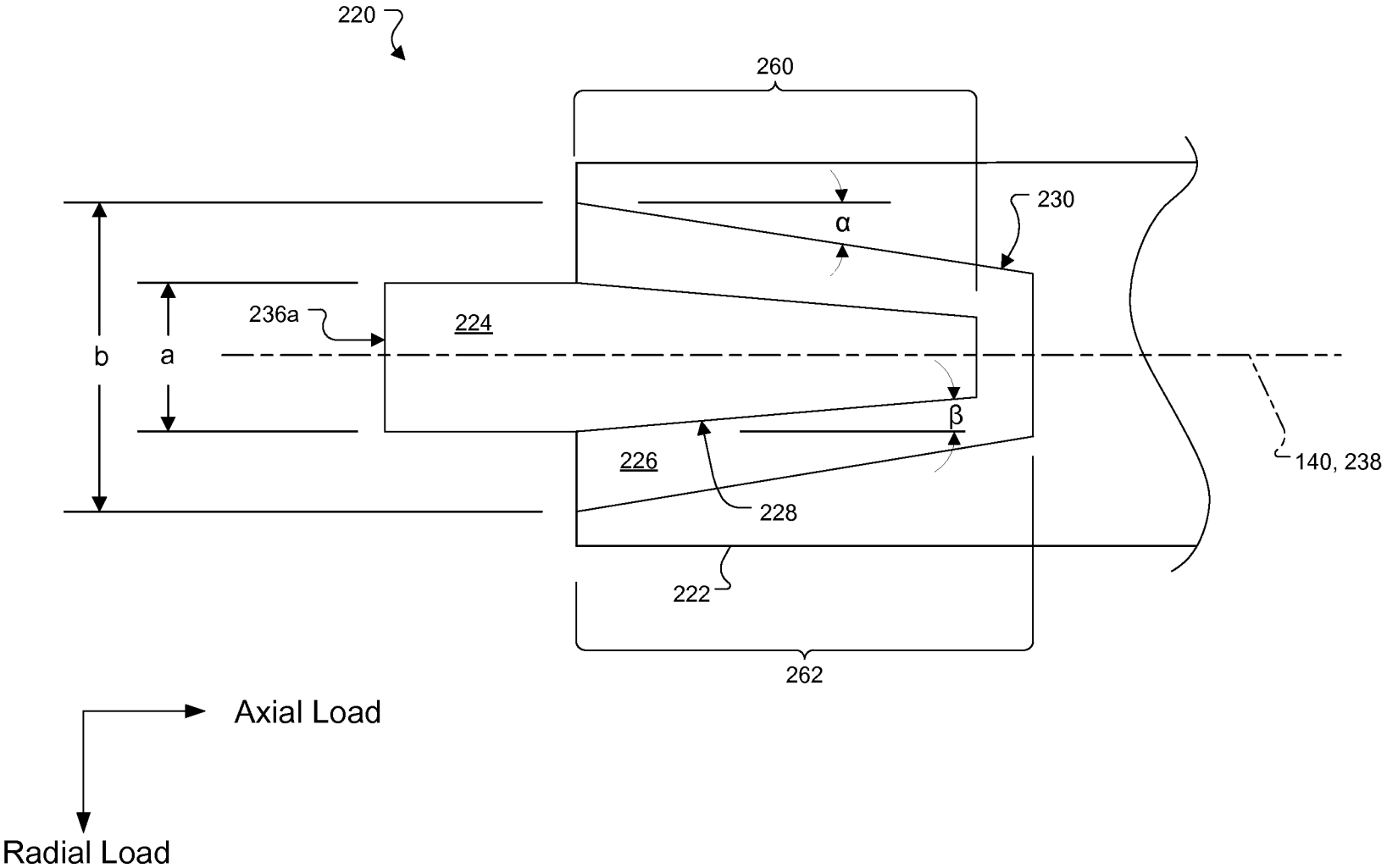
FIG. 7B is a cross-sectional side view of an elastomeric torsion bushing from the pivot of FIG. 7A, taken along line 7B-7B.

FIGS. 7A and 7B illustrate another implementation of a pivot 214 that can be employed, for example, in the loudspeaker 100 of FIG. 1A and which may be particularly beneficial where the magnetic crashing forces are high in the axial direction. The pivot 214 includes a pair of conical elastomeric torsion bushings 220 arranged along the axis of rotation 140 of the lever 110 with a shaft member 221 extending therebetween.

Each elastomeric torsion bushing 220 includes a first, outer (housing) member 222; a second, inner (pin) member 224; and an elastomeric member 226 disposed therebetween and bonded thereto. A first end 236*a* of the inner member 224 is fixed to a mechanical ground reference, such as the enclosure 104 (FIG. 1A) or the frame 108 (FIG. 1A) and such that a longitudinal axis 238 of the inner member 224 is coincident with the axis of rotation 140 of the lever 110. The outer member 222 is coaxial with the inner member 224 and is secured to the lever 110 such that the outer member 222 rotates with the lever 110 relative to the inner member 224. A first (inner) surface 228 of the elastomeric member 226 is bonded to the inner member 224 and a second (outer) surface 230 of the elastomeric member 226 is bonded to the outer member 222 such that the second surface 230 moves with the outer member 222 (e.g., during rotation of the lever) relative to the inner surface 228. In some cases, the lever 110 and the outer member 222 may both be part of one unitary structure. For example, the outer members 222 can be integral with the shaft member 221, which can be integral with the lever 110.

In this implementation, the elastomeric member 226 is in the form of frusto-cone having a hollow center region 260. The frusto-cone has an outer diameter "b" that tapers at a first taper angle α along the length of the frusto-cone and an inner diameter "a" that tapers at a second taper angle β along the length of the hollow center region 260. The first and second taper angles α, β differ, with the second taper angle β being smaller than the first taper angle α, so as to maintain a substantially constant thickness ratio "t" of the elastomeric member 226 along the length of the hollow center region 260. The thickness ratio "t" is the ratio of the outer diameter "b" over the inner diameter 'a.' It has been found that a thickness ratio "t" of about 1.2 to about 3 generally provides a bushing with sufficiently low peak strain and torsional stiffness (e.g., 0.1-1 Nm/rad), and sufficiently high axial stiffness (e.g., 50-500 N/mm) and radial stiffness (e.g., 200-2000 N/mm).

The outer member 222 includes a tapered recess 262 within which the elastomeric member 226 is disposed. The tapered recess 262 tapers at the first taper angle α so that the outer surface 230 of the elastomeric member 226 conforms to the shape of the tapered recess 262 allowing for an intimate bond between the elastomeric member 226 and the outer member 222. The inner member 224 includes a tapered end portion 264 that is received within the hollow center region 260 of the elastomeric member 226. The tapered end portion 264 tapers at the second taper angle β so that the inner surface 228 of the elastomeric member 226 conforms to the shape of the tapered end portion 264 allowing for an intimate bond between the elastomeric member 226 and the inner member 224. The introduction of these tapered surfaces along the axial direction of the pivot 214 allow for compression of the elastomeric member 226 between the tapered surfaces of the outer and inner members 222, 224 in the axial direction. The compression of the elastomeric member 226 can assist the shear strength of the bonds between the elastomeric member 226 and the outer and inner members 222, 224 in resisting magnetic crashing forces in the axial direction.

Other Implementations

Figure 8A:
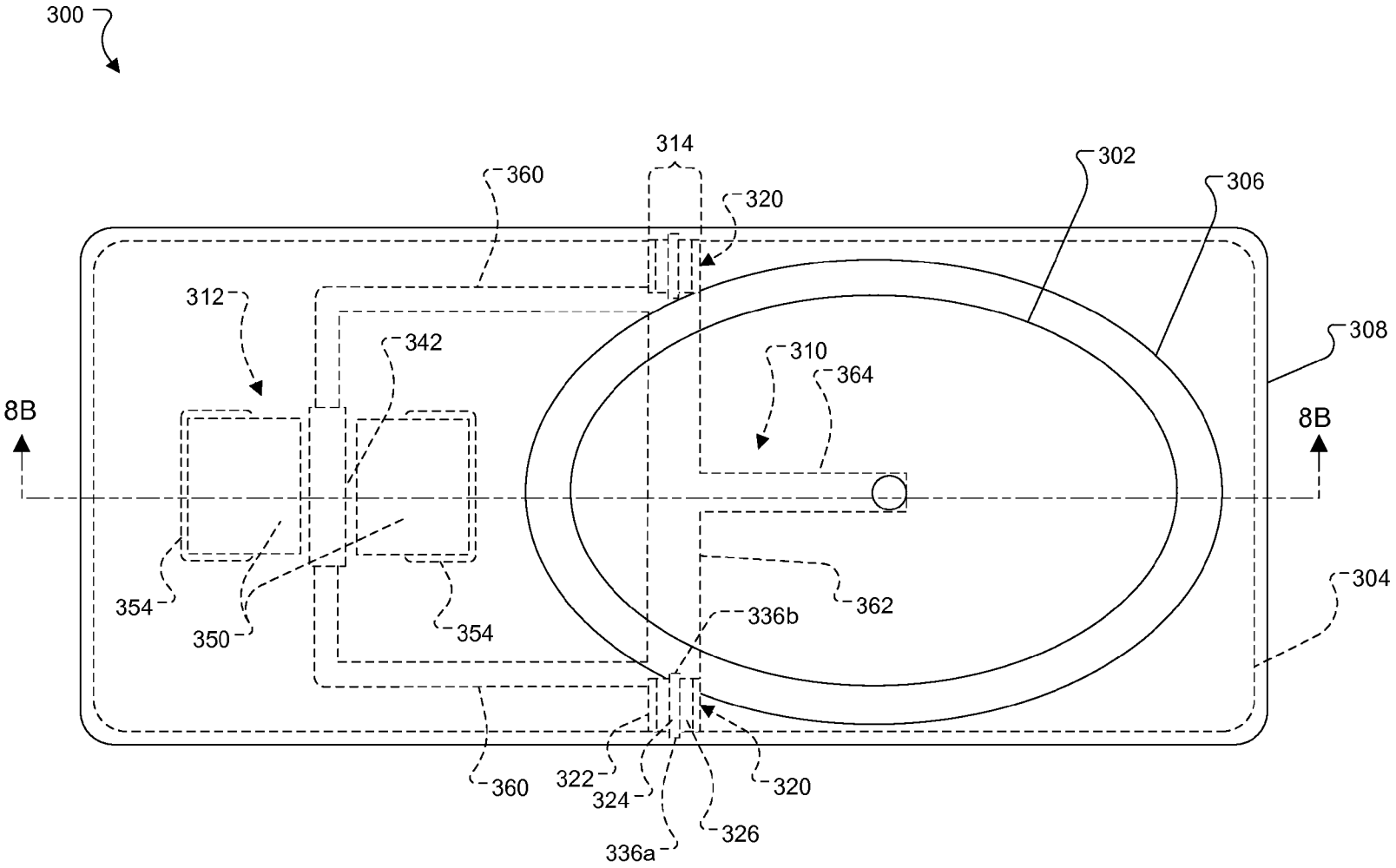
FIG. 8A is a top plan view of another implementation of a loudspeaker that employs elastomeric torsion bushings for providing a pivot for a lever that drives an acoustic diaphragm.
Figure 8B:
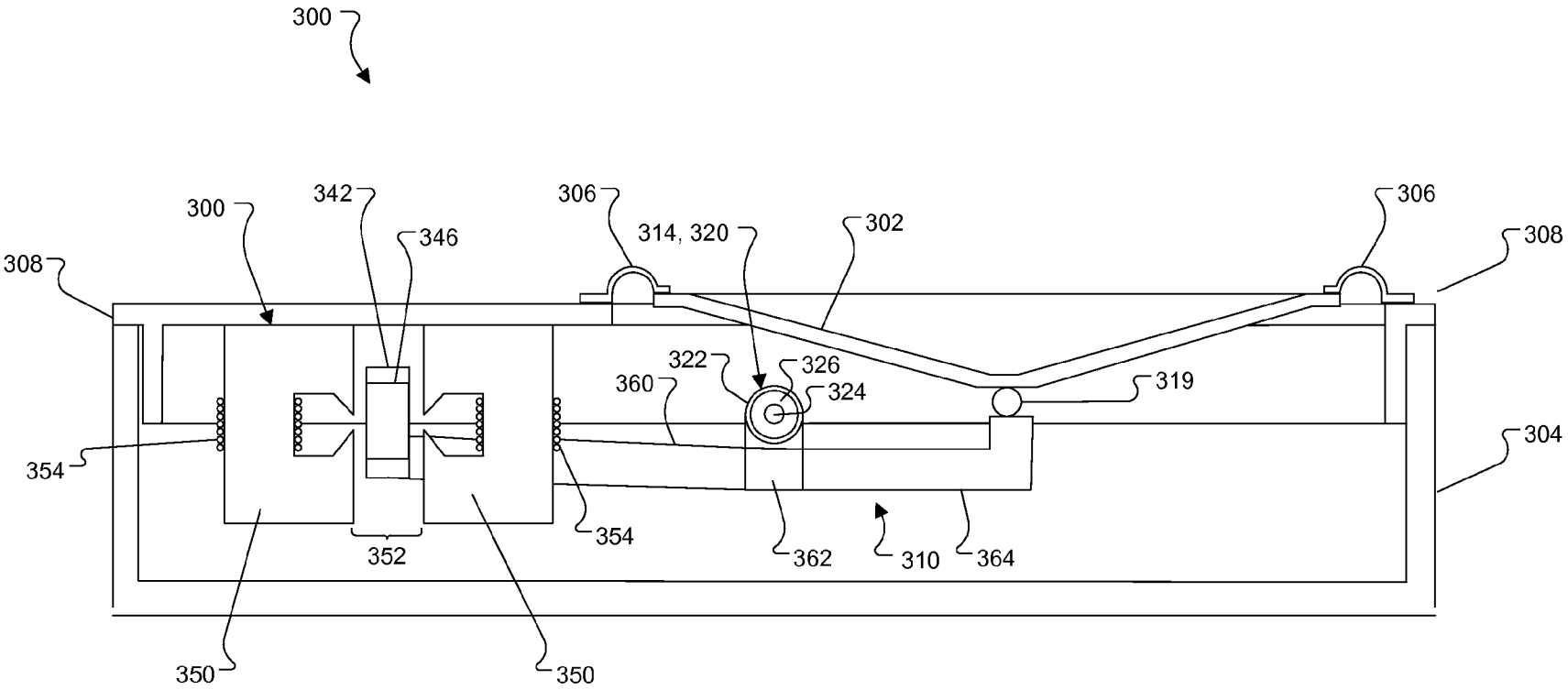
FIG. 8B is a cross-sectional side view of the loudspeaker of FIG. 8A, taken along line 8B-8B.

FIGS. 8A and 8B illustrate another example of a loudspeaker 300 that includes an acoustic diaphragm 302 that is mounted to an enclosure 304 by a surround 306. In the illustrated example, the surround 306 is mounted to a frame 308 and the frame 308 is connected to the enclosure 304. A lever 310 couples an armature 342 to the acoustic diaphragm 302 for transmitting motion of the armature 342 to the acoustic diaphragm 302.

The armature 342 includes one or more permanent magnets 346 (one shown, FIG. 8B). The armature 342 is driven by a stator 348, which provides a magnetic flux for the one or more permanent magnets 346 to interact with, thereby to drive motion of the acoustic diaphragm. The stator 348 that includes one or more cores 350 (two shown) which define an air gap 352. The cores 350 are formed of high magnetic permeability material around which coils 354 are wound. The lever 310 is positioned such that the armature 342 is in the air gap 352 and electrical current is passed through the coils so that that the combination of the armature 342, the cores 350, and the coils 354 form a moving magnet motor 312. In this arrangement, the force results from the interaction of the magnetic field in the gap due to the current flowing in the coils 354 and the magnetic field of the permanent magnet 346, so the force is applied to the lever 310 in a non-contact manner.

The lever 310 is pivotally connected to a mechanical ground reference, such as the enclosure 304 or the frame 308 of the loudspeaker 300, at a pivot 314 such that the lever 310 moves in an arcuate path. The lever 310 includes a pair of support arms 360 that are fixed to the pivot 314 and support the armature 342. A cross-member 362 connects the support arms 360 to a lever arm 364. The lever arm 364 is connected to the acoustic diaphragm 302 via a connector 319, such as a hinge, which allows the lever 310 to move relative to the acoustic diaphragm 302, thereby to allow the acoustic diaphragm 302 to move in a pistonic motion, rather than following the arcuate path of the lever 310.

The pivot 314 includes a pair of elastomeric torsion bushings 320 which are connected to each other via the cross-member 362 of the lever 310. In the illustrated example, each of the bushings 320 includes an inner (pin) member 324 that includes a first end 336*a* that is fixed to a mechanical ground reference, such as the enclosure 304 or the frame 308 of the loudspeaker 300; and a second, free end 336*b* opposite the first end 336*a*. An elastomeric member 326 circumferentially surrounds and is bonded to the inner member 324. An outer (housing) member 322 circumferentially surrounds and is bonded to the elastomeric member 326. As in the examples discussed above, the elastomeric member 326 is formed of an elastomer and can have a thickness ratio "t" of about 1.2 to about 3.

Figure 9:
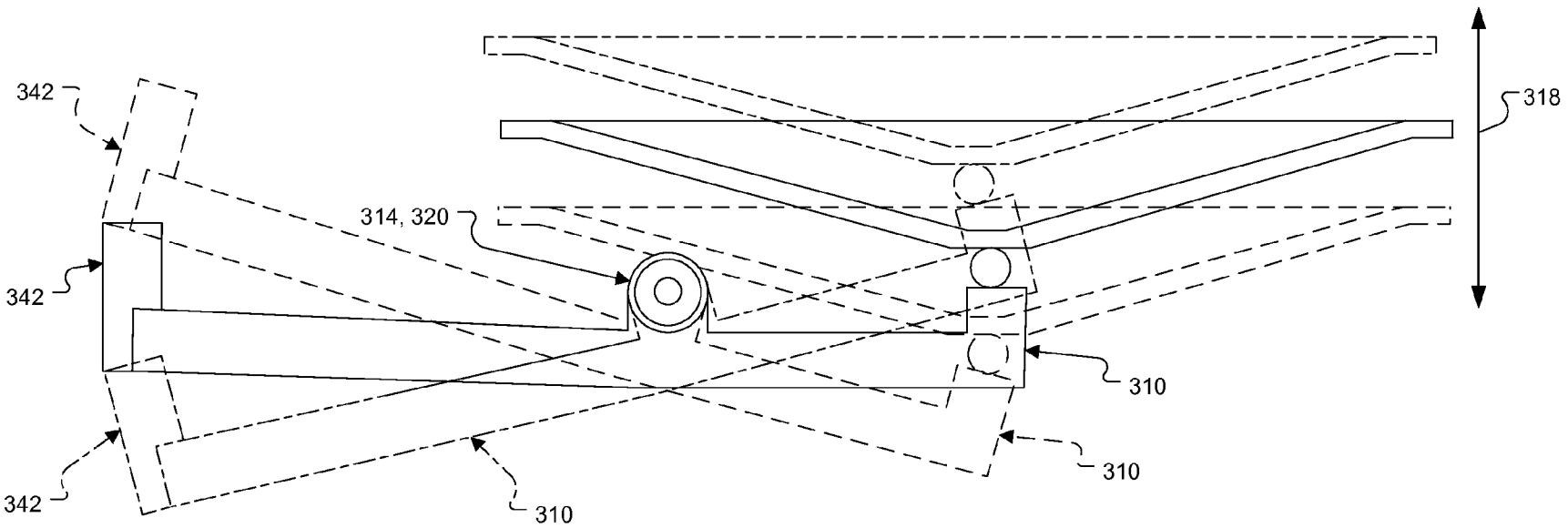
FIG. 9 illustrates oscillatory, arcuate movement of the lever and pistonic movement of an acoustic diaphragm of the loudspeaker of FIG. 8A.

Referring now to FIG. 9, the lever 310, in combination with the interaction between the armature 342 and the stator 348 (not shown in FIG. 9), moves the acoustic diaphragm 302 in a pistonic motion (as indicated by arrow 318). Notably, the bushings 320 are spaced apart from each other and the cross-member 362 (FIG. 8A) is offset from the bushings 320 such that the diaphragm is free to move therebetween, e.g., during a retraction.

Also worth noting is that in the implementation illustrated in FIGS. 8A, 8B, and 9, the moving magnet motor is arranged such that magnetic crashing forces resulting from interaction between the stator and the one or more permanent magnets 346 are substantially in the radial direction and perpendicular to the axis of rotation of the lever. In this regard, the high radial stiffness offered by the elastomeric torsion bushings 320 can be particularly beneficial to inhibit crashing.

In some implementations, a frusto-cone bushing, such as illustrated in FIG. 7B, may also be used with the motor implementation of FIGS. 8A and 8B.

Figure 10:
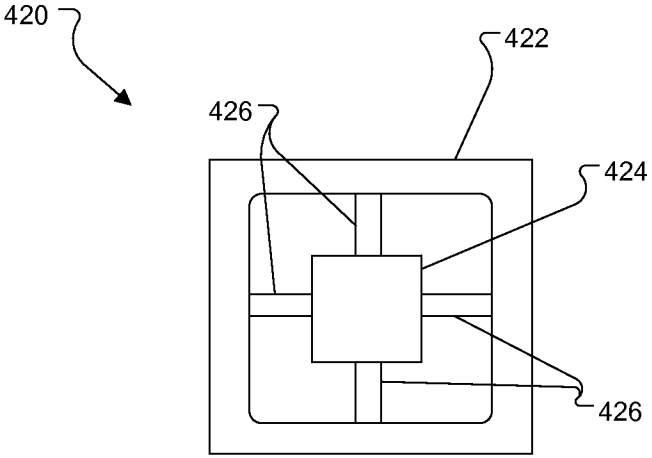

FIG. 10 illustrates another implementation of an elastomeric torsion bushing 420 that can be utilized, for example, in the pivots in the loudspeakers described above. The bushing 420 includes a pivot shaft 424. A plurality of elastomeric ribs 426 connect the pivot shaft 424 to a rigid housing 422 such that the rigid housing 422 can rotate relative to the pivot shaft 424. Each of the ribs 426 includes a first end that is bonded to the pivot shaft 424 and a second end that is bonded to and moves with the rigid housing 422.

In some cases, the pivot shaft 424 can have at least one of its ends fixed to a mechanical ground reference, such as an enclosure or a frame of a loudspeaker, and the rigid housing 422 can be secured to a lever used for driving an acoustic diaphragm of the loudspeaker.

Alternatively, the rigid housing 422 can be fixed to a mechanical ground reference, such as an enclosure or a frame of a loudspeaker, and the pivot shaft 424 can be secured to a lever used for driving an acoustic diaphragm of the loudspeaker.

Figure 11:
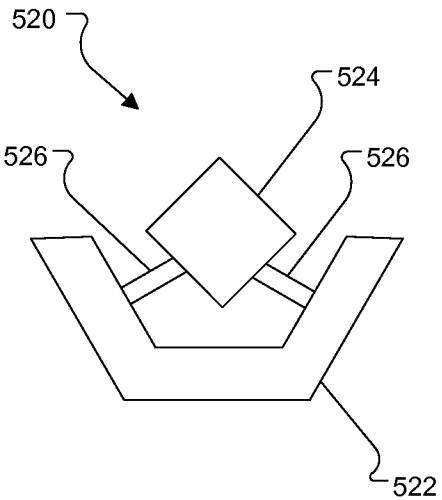
FIGS. 10 and 11 are end views of alternative implementations of elastomeric torsion bushings.

FIG. 11 illustrate yet another implementation of an elastomeric torsion bushing 520 that can be utilized in the pivots of the loudspeakers described above. The bushing 520 includes a pivot shaft 524. A pair of elastomeric ribs 526 connects the pivot shaft 524 to a rigid housing 522. The pivot shaft 524 can have at least one of its ends fixed to a mechanical ground reference, such as an enclosure or a frame of a loudspeaker, and the rigid housing 522 can be secured to a lever used for driving an acoustic diaphragm of a loudspeaker. The rigid housing 522 can rotate relative to the pivot shaft 524. Each of the ribs 526 includes a first end that is bonded to the pivot shaft 524 and a second end that is bonded to and moves with the rigid housing 522. In the implementation of FIG. 11, the housing 522 only partially surrounds the pivot shaft 524.

Alternatively, the rigid housing 522 can be fixed to a mechanical ground reference, such as an enclosure or a frame of a loudspeaker, and the pivot shaft 524 can be secured to a lever used for driving an acoustic diaphragm of the loudspeaker.

While an oscillatory force source in the form of a moving magnet motor has been described, the oscillatory force may instead be applied with a moving coil motor in which a coil wound on a bobbin moves with the lever. The motor also includes a stationary permanent magnet and a stator defining an air gap, in which the bobbin moves. Electrical current is passed through the coil so that that the combination of the magnet, core, and coil form a moving coil motor. Force results from interaction of a magnetic field due to the current flowing in the coil and a magnetic field from the stationary permanent magnet so the force is applied to the lever in a non-contact manner. Alternatively, the oscillatory force may be applied mechanically, for example, by connecting the lever to a linear actuator.

Figure 12A:
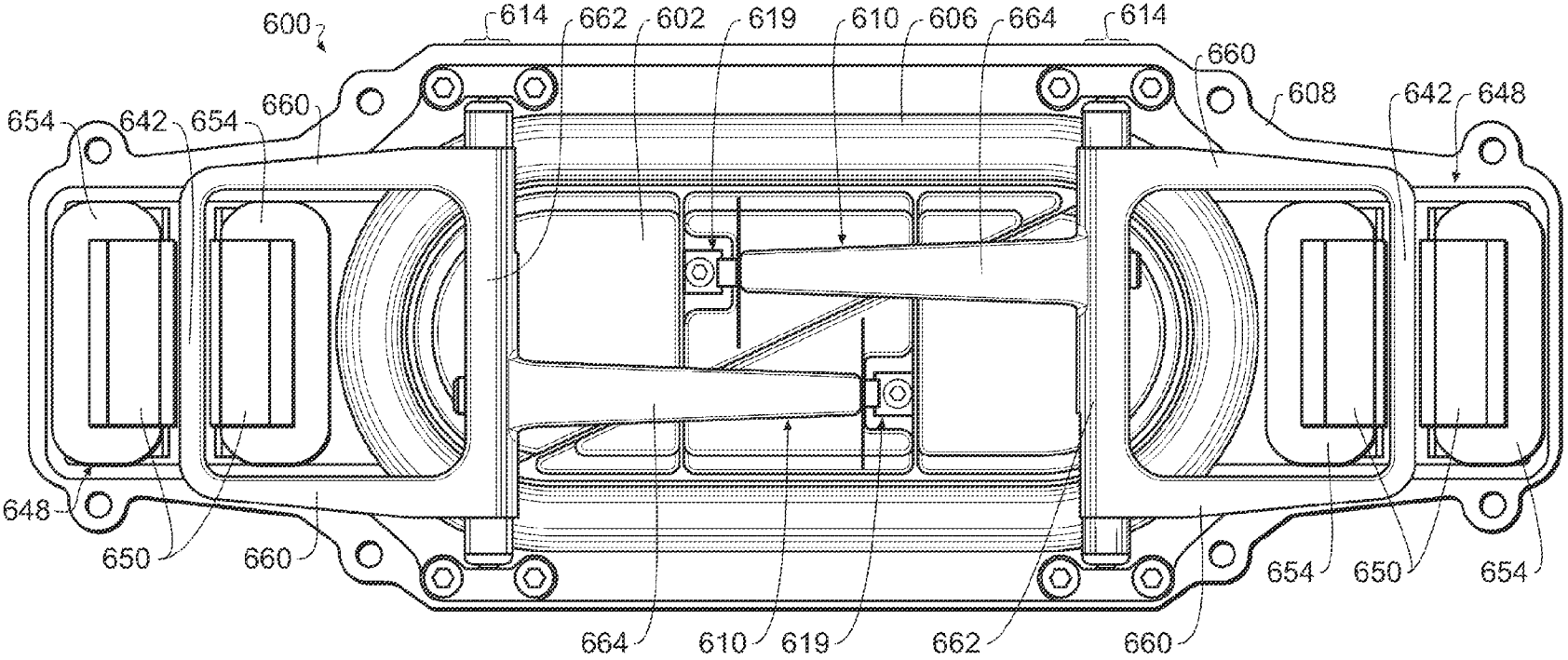
FIGS. 12A and 12B are plan and perspective views, respectively, of a multi-lever loudspeaker.
Figure 12B:
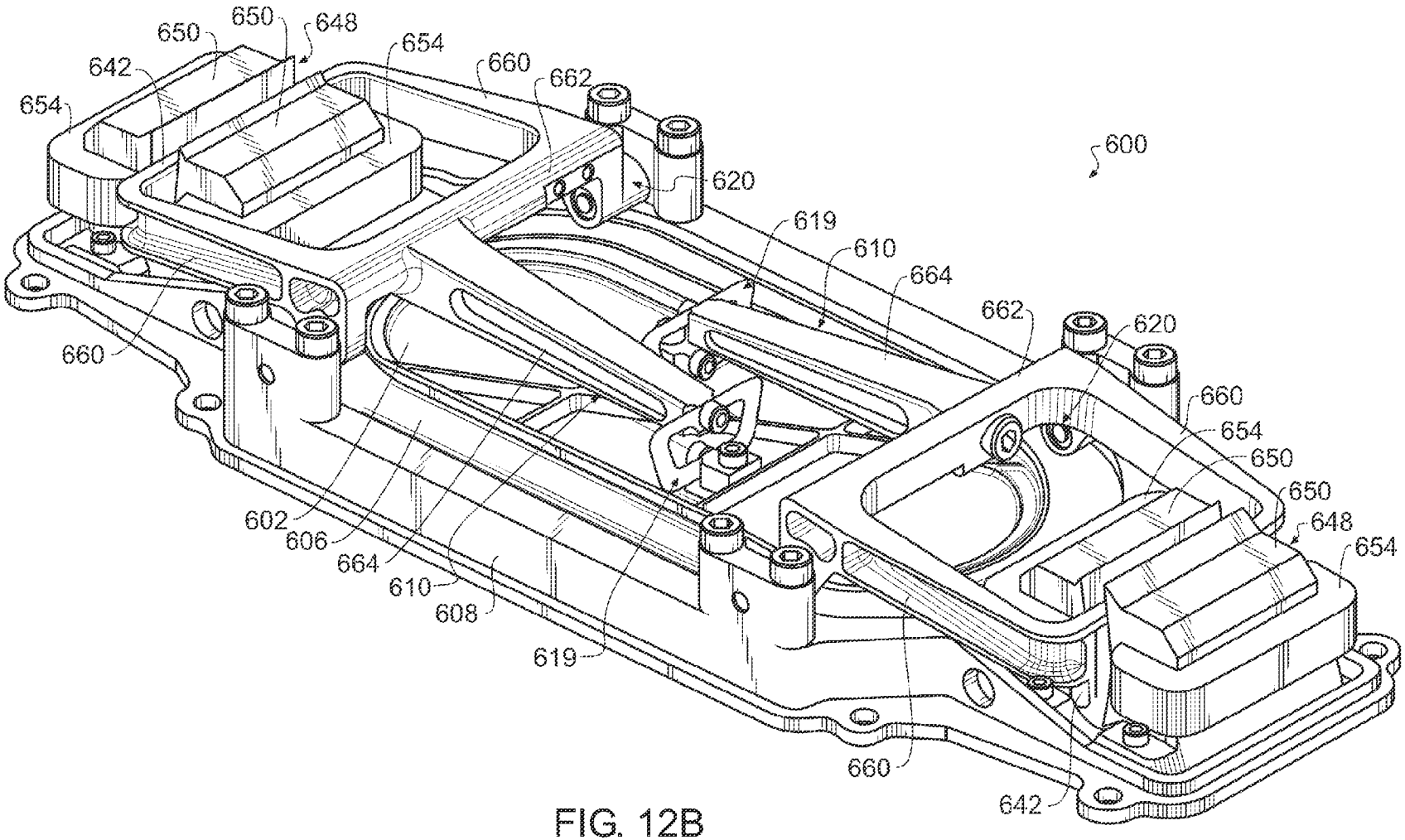
Figure 12C:
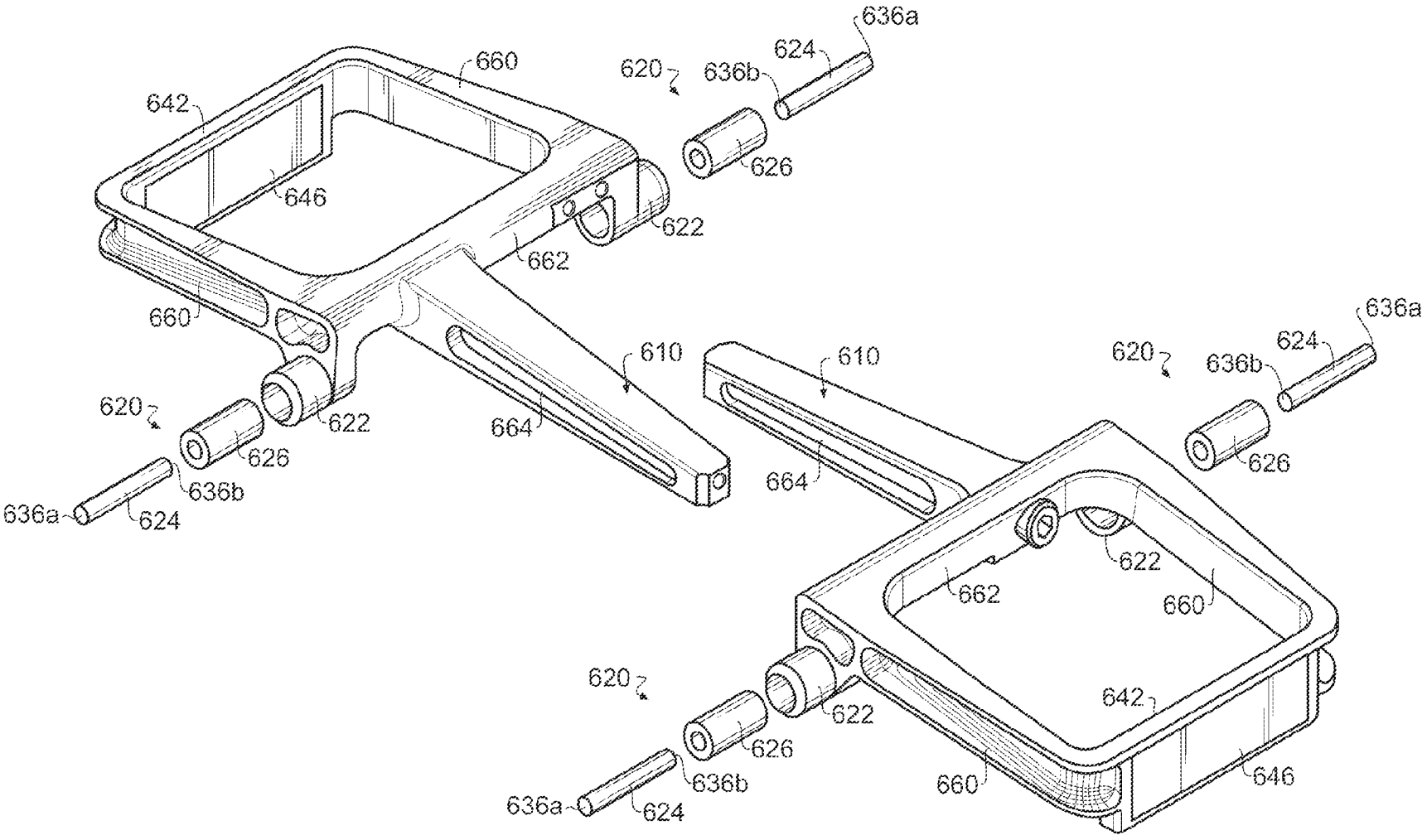
FIG. 12C is an exploded perspective view of the levers from the loudspeaker of FIG. 12A showing details of elastomeric torsion bushings.

Although implementations have been described which include a single lever for driving motion of an acoustic diaphragm, multi-lever configurations are also possible. For example, FIGS. 12A and 12B are plan and perspective views, respectively, of an implementation of a loudspeaker 600 that includes plural levers 610 (two shown). FIG. 12C is an exploded perspective view of the levers 610 from the loudspeaker of FIG. 12A showing the details of the pivots 620.

In the implementation illustrated in FIGS. 12A through 12C, the levers 610 are configured to rotate about respective pivots 614. The pivots 614 are arranged inboard of a pair of armatures 642, each of the armatures 642 being associated with a corresponding one of the levers 610.

In the illustrated example, an acoustic diaphragm 602 is mounted to an frame 608 by a surround 606. The surround 606 is mounted to the frame 608 and the frame 208 can be connected to an enclosure (not shown). The levers 610 couple the armatures 642 to the acoustic diaphragm 602 for transmitting motions of the armatures 642 to the acoustic diaphragm 602.

Each of the armatures 642 includes a permanent magnet 646 (FIG. 12C), and each armature 642 is driven by an associated stator 648. The stators 648 provide magnetic flux for the permanent magnets 646 to interact with, thereby to drive motion of the acoustic diaphragm 602. Each of the stators 648 includes a pair of cores 650, which together define an air gap within which an associated one of the armatures 642 is disposed. The cores 650 can be secured to the frame 608 (e.g., with an adhesive).

Each core 650 includes a coil 654 of electrically conductive material wound about it. Current in coils 654 produce magnetic flux across the air gaps. The magnetic flux interacts with the permanent magnets 646 of the armatures 642 to drive the motion of the acoustic diaphragm 602.

Each lever 610 includes a pair of support arms 660 that support the armature 642. A cross-member 662 connects the support arms 660 to a lever arm 664. Each lever arm 664 is connected to the acoustic diaphragm 602 via connector 619, such as a hinge or flexure, which allows the levers 610 to move relative to the acoustic diaphragm 602, thereby to allow the acoustic diaphragm 602 to move in a pistonic motion, rather than following the arcuate path of the levers 610.

Figure 13A:
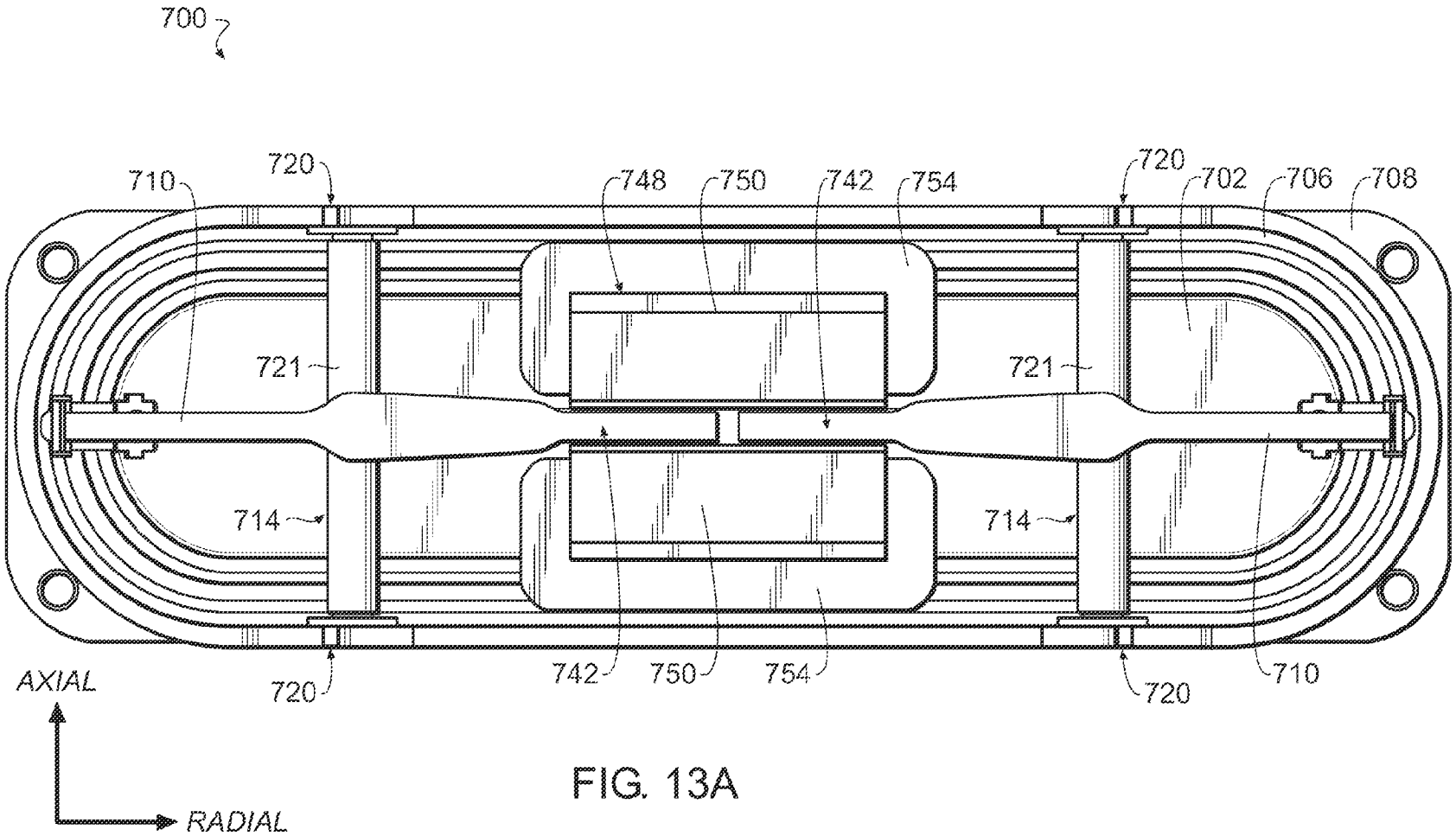
FIGS. 13A and 13B are plan and perspective views, respectively, of another implementation of a multi-lever loudspeaker.
Figure 13B:
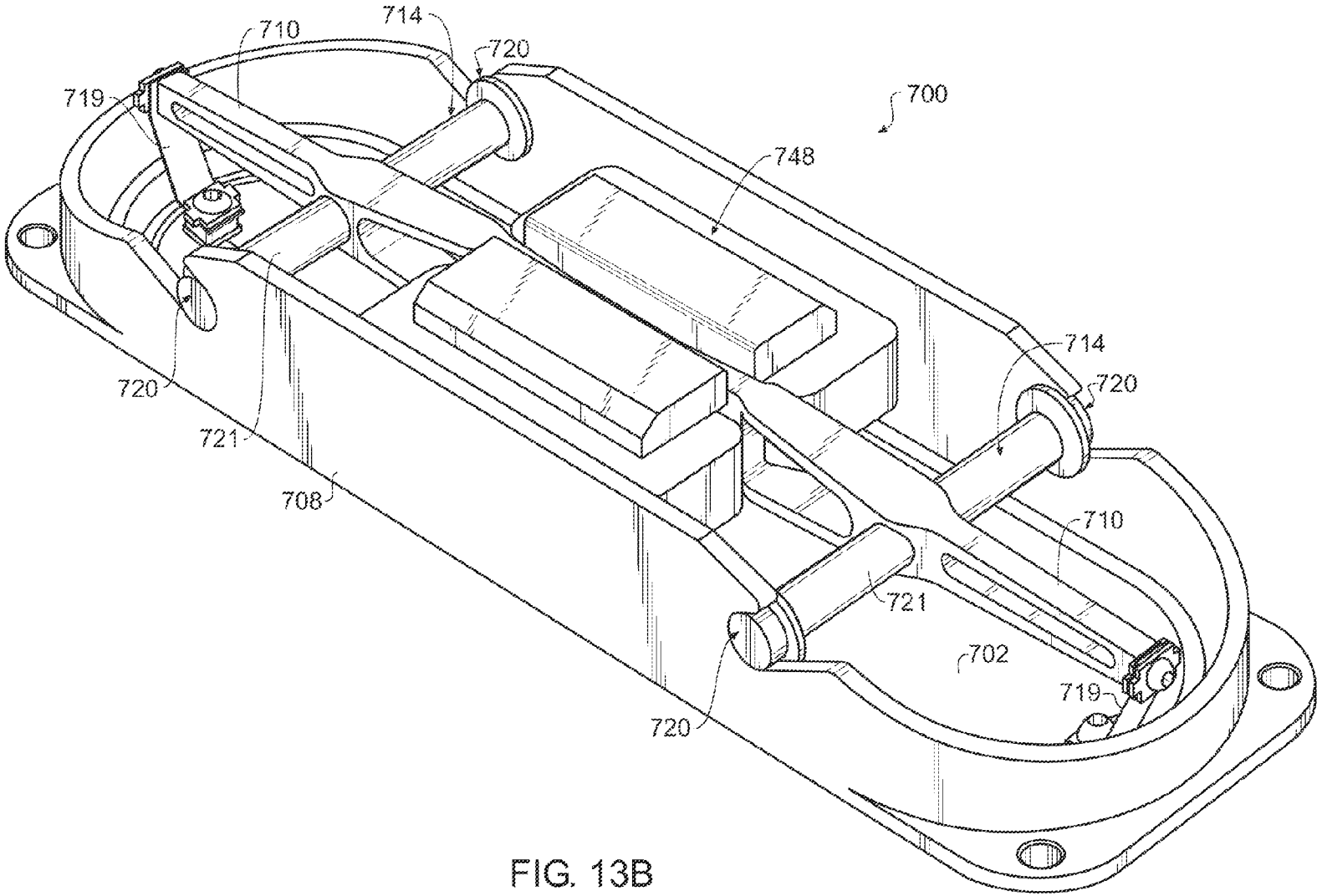
Figure 13C:
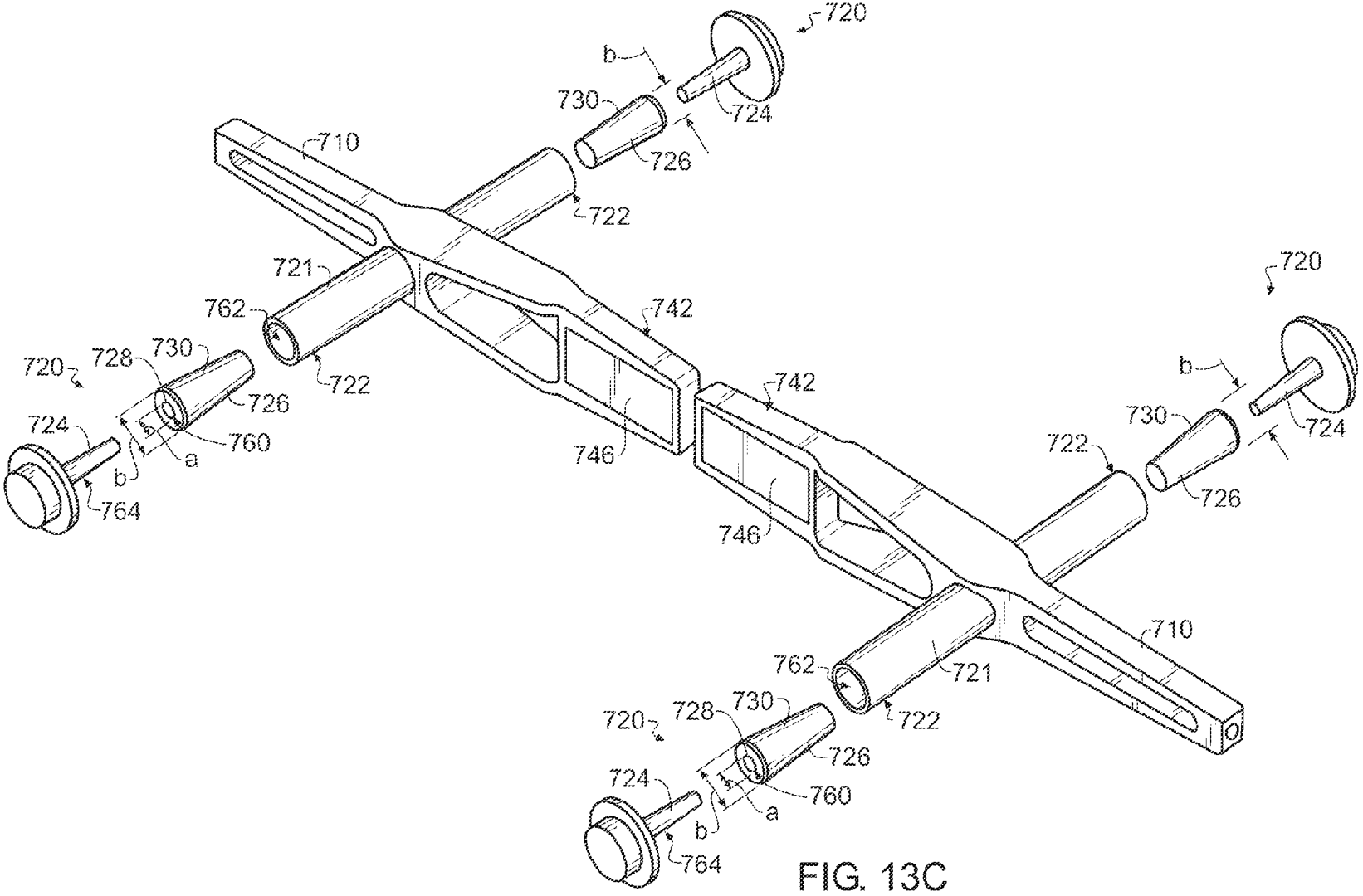
FIG. 13C is an exploded perspective view of the levers from the loudspeaker of FIG. 13A showing details of elastomeric torsion bushings.

Referring to FIG. 12C, the pivots 614 each include a pair of elastomeric torsion bushings 620 which are connected to each other via the cross-member 662 of the corresponding one of the levers 610. In the illustrated example, each of the bushings 620 includes an inner (pin) member 624 that includes a first end 636*a* that is fixed to a mechanical ground reference, such as the frame 608 of the loudspeaker 600; and a second, free end 636*b* opposite the first end 636*a*. An elastomeric member 626 circumferentially surrounds and is bonded to the inner member 624. An outer (housing) member 622 circumferentially surrounds and is bonded to the elastomeric member 626. As in the examples discussed above, the elastomeric member 626 is formed of an elastomer and can have a thickness ratio "t" of about 1.2 to about 3. FIGS. 13A, 13B, and 13C illustrate another implementation of a multi-lever loudspeaker that utilizes the conical elastomeric torsion bushings of FIG. 7A. Referring to FIGS. 13A and 13B, the loudspeaker 700, includes a mechanical load, in this example an acoustic diaphragm 702 (e.g., a cone type speaker diaphragm, also known simply as a "cone"), that is mounted to a frame 708 via a surround 706. The frame 608 may be secured to an enclosure (not shown). The loudspeaker 700 also includes a pair of levers 710 each of which couples an associated armature 742 to the acoustic diaphragm 602 for transmitting motion of the armatures 742 to the acoustic diaphragm 602 to cause the acoustic diaphragm 602 to move, relative to the frame 708.

Notably, in the implementation shown in FIGS. 13A through 13C both of the armatures 742 are driven by a single, common stator 748, which provides a magnetic flux for the permanent magnets 746 (FIG. 13C) of both of the armatures 742 to interact with, thereby to drive motion of the acoustic diaphragm 702.

The stator 748 can include a pair of U-shapes cores 750 of high magnetic permeability material, such as soft iron. Each core 750 includes a coil 754 of electrically conductive material wound about it. The cores 750 are arranged adjacent to each other and define an air gap therebetween, which is substantially filled by the armatures 742. The air gap is a single, common air gap that is shared by both armatures 742.

Current in coils 754 produces a magnetic flux across the air gap. The magnetic flux interacts with the permanent magnets 746 of the armatures 742 to drive the motion of the acoustic diaphragm 702. The combination of the armatures 742, the cores 750, and the coils 754 form a moving magnet motor. The interaction of the magnetic field in the air gap due to current flowing in the coils 754 and magnetic fields of the magnets 746 apply force to the magnets 746 in a non-contact manner. Force from the magnets 746 is coupled structurally to the levers 710 and ultimately to the acoustic diaphragm 702.

Each of the levers 710 is pivotally connected to a mechanical ground reference, such as the frame 108 of the loudspeaker 100, such that the levers 710 each move in an arcuate path about respective pivots 714. The armatures 742 and the stator 748 are positioned beneath the acoustic diaphragm 702 with the pivots 714 being arranged outboard of the armatures 742. That is, the armatures 742 are disposed between the pivots 714 of the levers 710.

Referring to FIG. 13C, the pivots 714 each include a pair of conical elastomeric torsion bushings 720 arranged along the axis of rotation of the associated lever 710 with a shaft member 721 extending therebetween.

Each elastomeric torsion bushing 720 includes a first, outer (housing) member 722; a second, inner (pin) member 724; and an elastomeric member 726 disposed therebetween and bonded thereto. A first end of the inner member 724 is fixed to a mechanical ground reference, such as the frame 708 (FIG. 13A) and such that a longitudinal axis of the inner member 724 is coincident with the axis of rotation of the lever 710. The outer member 722 is coaxial with the inner member 724 and is secured to the lever 710 such that the outer member 722 rotates with the lever 710 relative to the inner member 724. A first (inner) surface 728 of the elastomeric member 726 is bonded to the inner member 724 and a second (outer) surface 730 of the elastomeric member 726 is bonded to the outer member 722 such that the second surface 730 moves with the outer member 722 (e.g., during rotation of the lever) relative to the inner surface 728. In some cases, the lever 710 and the outer member 722 may both be part of one unitary structure. For example, the outer members 722 can be integral with the shaft member 721, which can be integral with the lever 710.

In this implementation, the elastomeric member 726 is in the form of frusto-cone having a hollow center region 760. The frusto-cone has an outer diameter "b" that tapers at a first taper angle along the length of the frusto-cone and an inner diameter "a" that tapers at a second taper angle along the length of the hollow center region 760. The first and second taper angles differ, with the second taper angle being smaller than the first taper angle, so as to maintain a substantially constant thickness ratio "t" of the elastomeric member 726 along the length of the hollow center region 760. The thickness ratio "t" is the ratio of the outer diameter "b" over the inner diameter "a." It has been found that a thickness ratio "t" of about 1.2 to about 3 generally provides a bushing with sufficiently low peak strain and torsional stiffness (e.g., 0.1-1 Nm/rad), and sufficiently high axial stiffness (e.g., 50-500 N/mm) and radial stiffness (e.g., 200-2000 N/mm).

The outer member 722 includes a tapered recess 762 within which the elastomeric member 726 is disposed. The tapered recess 762 tapers at the first taper angle α so that the outer surface 730 of the elastomeric member 726 conforms to the shape of the tapered recess 762 allowing for an intimate bond between the elastomeric member 726 and the outer member 722. The inner member 724 includes a tapered end portion 764 that is received within the hollow center region 760 of the elastomeric member 726. The tapered end portion 764 tapers at the second taper angle so that the inner surface 728 of the elastomeric member 726 conforms to the shape of the tapered end portion 764 allowing for an intimate bond between the elastomeric member 726 and the inner member 724. The introduction of these tapered surfaces along the axial direction of the pivot 714 allow for compression of the elastomeric member 726 between the tapered surfaces of the outer and inner members 722, 724 in the axial direction. The compression of the elastomeric member 726 can assist the shear strength of the bonds between the elastomeric member 726 and the outer and inner members 722, 724 in resisting magnetic crashing forces in the axial direction.

A number of implementations have been described. Nevertheless, it will be understood that additional modifications may be made without departing from the spirit and scope of the inventive concepts described herein, and, accordingly, other implementations are within the scope of the following claims.

What is claimed is:

1. A loudspeaker comprising:
- an acoustic diaphragm;
- an enclosure;
- a surround connected to the acoustic diaphragm;
- an oscillatory force source contained by the enclosure;
- a lever coupling the oscillatory force source to the acoustic diaphragm; and
- a pivot coupled to the lever such that the lever moves in an arcuate path about the pivot when the oscillatory force source applies a force to the lever,
- wherein the pivot comprises at least one torsion bushing, the at least one torsion bushing comprising:
  - a first member;
  - a second member coupled to the lever and movable relative to the first member; and
  - an elastomeric member coupling the first member to the second member, wherein the first member is fixed in position relative to the enclosure.

2. The loudspeaker of claim 1, wherein the elastomeric member is formed of an elastomer selected from the group consisting of silicone rubber, and polyurethane.

3. The loudspeaker of claim 1, wherein a first surface of the elastomeric member is bonded to the first member, and wherein a second surface of the elastomeric member is bonded to the second member such that the second surface moves with the second member relative to the first surface.

4. The loudspeaker of claim 1, wherein the elastomeric member is formed between the first and second members in a mold-in-place process.

5. The loudspeaker of claim 1, wherein the elastomeric member is bonded to the first member and the second member with an adhesive.

6. The loudspeaker of claim 1, wherein the elastomeric member is in the form of a frusto-cone having a hollow center region, and wherein the frusto-cone has an outer diameter that tapers at a first taper angle along the length of the frusto-cone and an inner diameter that tapers at a second taper angle along the length of the hollow center region.

7. The loudspeaker of claim 6, wherein the second taper angle is smaller than the first taper angle such that the elastomeric member has a substantially constant thickness ratio along the length of the hollow center region, and wherein the thickness ratio is the ratio of the outer diameter to the inner diameter, and wherein the second member includes a tapered recess within which the elastomer is disposed, wherein the tapered recess tapers at the first taper angle, and wherein the first member comprises a tapered portion that tapers at the second taper angle.

8. The loudspeaker of claim 7, wherein the elastomeric member has a thickness ratio of about 1.2 to about 3.

9. The loudspeaker of claim 1, wherein the elastomeric member is in the form of a hollow cylinder having a thickness ratio of about 1.2 to about 3, and wherein the thickness ratio is the ratio of an outer diameter of the hollow cylinder to an inner diameter of the hollow cylinder.

10. The loudspeaker of claim 1, wherein the elastomeric member comprises a plurality of elastomeric ribs each having a first end connected to the first member and a second end connected to the second member.

11. The loudspeaker of claim 1, wherein at least one end of the first member is secured to the enclosure.

12. The loudspeaker of claim 1, wherein the surround is mounted to a frame and the frame is connected to the enclosure, and wherein at least one end of the first member is secured to the enclosure via the frame.

13. The loudspeaker of claim 1, wherein the oscillatory force source comprises:
- a moving magnet motor comprising:
  - an armature coupled to the lever and comprising a permanent magnet; and
  - a stator for creating magnetic flux for the armature to interact with, thereby to drive motion of the acoustic diaphragm.

14. The loudspeaker of claim 13, wherein the moving magnet motor is arranged such that magnetic crashing forces resulting from magnetic attraction between the stator and the one or more permanent magnets are substantially parallel to an axis of rotation of the lever.

15. A loudspeaker comprising:
- an acoustic diaphragm;
- an enclosure
- a surround connected to the acoustic diaphragm;
- a moving magnet motor contained by the enclosure, the motor comprising:
  - an armature comprising a permanent magnet, and
  - a stator for creating magnetic flux for the armature to interact with, thereby to drive motion of the armature;
- a lever coupling the armature and the acoustic diaphragm to transmit motion of the armature to the acoustic diaphragm to cause the acoustic diaphragm to move,
- a pivot coupled to the lever so that motion of the armature causes the lever to move in an arcuate path about the pivot,
- wherein the pivot comprises:
  - a pair of elastomeric torsion bushings, each of the elastomeric torsion bushings comprising:
    - a first member;
    - a second member coupled to the lever and movable relative to the first member; and an elastomeric member coupling the first member to the second member, wherein each of the first members fixed in position relative to the enclosure.

16. The loudspeaker of claim 15, wherein the elastomeric torsion bushings are spaced apart so as to allow the acoustic diaphragm to move therebetween.

17. The loudspeaker of claim 15, wherein the elastomeric members each have the form of a frusto-cone having a hollow center region, and wherein the frusto-cone has an outer diameter that tapers at a first taper angle along the length of the frusto-cone and an inner diameter that tapers at a second taper angle along the length of the hollow center region.

18. The loudspeaker of claim 17, wherein the second taper angle is smaller than the first taper angle such that the elastomeric member has a substantially constant thickness ratio along the length of the hollow center region, and wherein the thickness ratio is the ratio of the outer diameter to the inner diameter, and wherein the second member includes a tapered recess within which the elastomer is disposed, wherein the tapered recess tapers at the first taper angle, and wherein the first member comprises a tapered portion that tapers at the second taper angle.

19. The loudspeaker of claim 18, wherein the elastomeric member has a thickness ratio of about 1.2 to about 3.

* * * * *